US005694045A

United States Patent [19]

Ikeda et al.

[11] Patent Number: 5,694,045

[45] Date of Patent: Dec. 2, 1997

[54] APPARATUS FOR DETERMINING PART OF OBJECT, AND OBJECT, PART OF WHICH CAN BE AUTOMATICALLY DETERMINED

[75] Inventors: Yuji Ikeda, Tokyo; Takeshi Yamamoto, Kyoto, both of Japan

[73] Assignee: Sega Enterproses, Ltd., Tokyo, Japan

[21] Appl. No.: 528,429

[22] Filed: Sep. 14, 1995

[30] Foreign Application Priority Data

Sep. 19, 1994 [JP] Japan ..... 6-223827

[51] Int. Cl.[6] ..... G01S 5/00

[52] U.S. Cl. ..... 324/652; 324/655; 324/207.15; 273/146; 273/145 R

[58] Field of Search ..... 273/146, 145 R, 273/145 A, 145 B, 145 C, 145 CA, 145 D, 145 E, 238, 239; 340/568, 686; 324/207.15, 207.16, 207.22, 652, 654, 655

[56] References Cited

U.S. PATENT DOCUMENTS

| | | | |
|---|---|---|---|
| 2,693,962 | 11/1954 | Stevens | 273/145 D |
| 3,683,351 | 8/1972 | Wilcox | 340/568 |
| 4,909,513 | 3/1990 | Kiyono | 273/145 R |
| 5,291,152 | 3/1994 | Seale | 324/207.16 |
| 5,519,381 | 5/1996 | Marsh et al. | 340/568 X |

FOREIGN PATENT DOCUMENTS

| | | |
|---|---|---|
| 426301 | 5/1991 | European Pat. Off. . |
| 55-86487 | 6/1980 | Japan . |
| 194879 | 4/1989 | Japan . |
| 1-198576 | 8/1989 | Japan . |
| 1-259888 | 10/1989 | Japan . |
| 2-249574 | 10/1990 | Japan . |
| 2-249575 | 10/1990 | Japan . |
| 5-42256 | 2/1993 | Japan . |
| 5-177056 | 7/1993 | Japan . |
| 5-212158 | 8/1993 | Japan . |
| 5-212159 | 8/1993 | Japan . |
| 7202770 | 4/1995 | Japan . |
| 1180560 | 2/1970 | United Kingdom . |

OTHER PUBLICATIONS

English Patent Abstract setting forth the relevant portions of the '770.

*Primary Examiner*—Michael Brock
*Attorney, Agent, or Firm*—Price, Gess & Ubell

[57] ABSTRACT

An object has a plurality of parts, wherein each part of the plurality of parts can face a predetermined direction. A plurality of resonant circuits are mounted in different predetermined positions of the object, and have different resonance frequencies. A sending unit sends signals having a plurality of frequencies corresponding to the resonance frequencies of the plurality of resonant circuits. A detecting unit detects resonance signals of the plurality of resonant circuits. A plate has therein the sending unit and detecting unit. A determining unit determines a part of the object placed on the plate, the part facing the predetermined direction, using differences of detected levels of the resonance signals of the plurality of resonant circuits of the object detected by the detecting unit.

16 Claims, 26 Drawing Sheets

FIG.
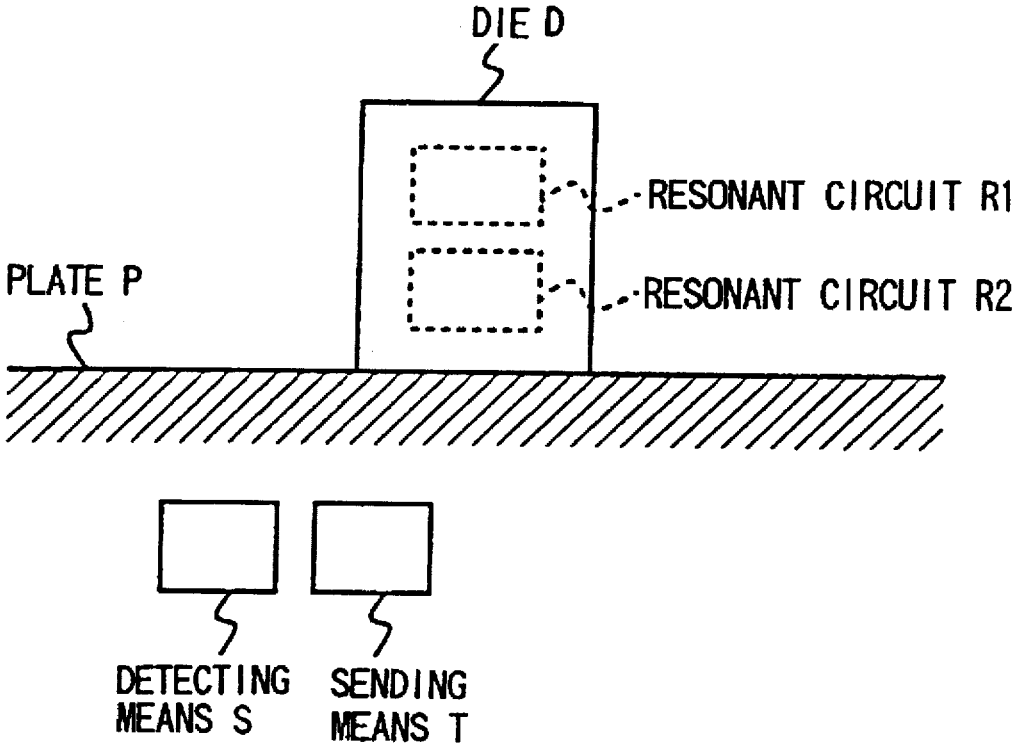

t1
TIME t1
TIME

APPARATUS FOR DETERMINING PART OF OBJECT, AND OBJECT, PART OF WHICH CAN BE AUTOMATICALLY DETERMINED

BACKGROUND OF THE INVENTION

1. Field of the Invention

The present invention relates to an apparatus for determining which part of an object is a relevant part, and, in particular, an apparatus for determining which side of a die is a relevant side of the die. The die is such as that used for determining a result of a game. By determining which part of the object is a relevant part, for example, a number (such as a number of the die) relevant to the determined part of the object can be determined. In other words, an apparatus which the present invention relates to is such that, for example, when a cube-shaped die, having six sides is thrown and then stops, the apparatus automatically determines which side of the die was rolled or is facing upward.

The present invention also relates to an object such as a die used for determining a result of a game, it being automatically determined which part of the object is a relevant part, that is, which side of the die is facing upward.

There is a game in which a game result is determined from a number of an object which is facing upward, the number being a number of a relevant part of the object. Such a game is, for example, a dice game such as craps using cube-shaped die. If a game apparatus for performing such a game is considered, it is preferable that the game apparatus has functions which will now be described. Each player guesses which number of a die will be rolled and inputs this guessed number to the game apparatus. Then, after the die has been thrown or rolled and then stops, the game apparatus automatically determines which number of the die is actually facing upward. Then, the game apparatus compares the determined number of the die with numbers previously guessed and input by players. Then, the game apparatus automatically determines a game result.

By using such a game apparatus, each player may immediately know the game result depending on his or her own guessed number and the actual rolled number of the die, and thus can easily enjoy the game. In order to realize such a game apparatus, the game apparatus should automatically determine a number of a relevant side of the stopped die, which side is facing a predetermined direction, in general, is facing upward (such a number of the die or the like being referred to as a 'rolled number', hereinafter).

2. Description of Related Art

For example, Japanese Laid-Open Patent Application Nos.5-212158 and 5-212159 disclose apparatuses for automatically determining a rolled number of an object or a die using a CCD sensor. Further, Japanese Laid-Open Patent Application Nos. 1-198576 and 1-94879 disclose apparatuses for automatically determining a rolled number of an object or a die using a television camera by which an image of the top side of the die is used to determine a rolled number of the die. Further, Japanese Laid-Open Patent Application No. 55-86487 discloses such an apparatus using a photoconductive device. In these apparatuses, a rolled number of a die is determined as a result of receiving light reflected by the die and analyzing the received light.

However, in such methods, it is necessary to surely receive light reflected by a specific side of a die. Therefore, to surely determine a rolled number, a spatial relationship of a sensor or a television camera, a light as a light source and a die, is limited. When a die is rolled on a plane, it is not possible to accurately predetermine a position at which the rolling die will naturally stop. Therefore, dispositions and directions of the sensor or camera and light should be predetermined appropriate for all possible positions at which the rolling die will stop. Therefore, it is necessary either to make an area in which the die may move extremely narrow, increase numbers of sensors or cameras and lights, or enable the sensors or cameras and lights to move in response to a movement of the die.

If an area in which the die may move is made extremely narrow, a player may lose interest in the game. If numbers of sensors or cameras and lights are increased, or a provision is made for moving the sensors or cameras and lights in response to the movement of the die, costs of the game apparatus may substantially increase. Further, if a thus-enlarged scale of such a rolled number determining apparatus is exposed to a player, the player may lose interest in the game. Further, the cameras and so forth may block a player's view. Further, it may be necessary to provide a calculating system for recognizing a pattern of a rolled number from a video signal obtained through a television camera or the like, and then compare the recognized pattern with reference patterns. A calculation amount required for such operations may be a substantially large one and thus the calculating system may be very expensive. Further, a time required for such calculating operations is substantially long. As a result, a player may lose interest in the game. Further, if a number of dice used in the game is increased, to two dice, three dice or the like, the above-mentioned tendency may increase accordingly.

Another method may be considered in which, instead of moving cameras and so forth in response to die movement, a stopped die is moved to a predetermined position, and then the camera is used to take a picture thereof. However, in such a method, a time is required for the stopped die to be moved. Thus, there may be a substantial time lag between a time a player has recognized a rolled number of the die and a time the game apparatus recognizes the rolled number of the die. Then, a further time is required for the game apparatus to determine a relevant game result, an allotment of predetermined points to players accordingly, and so forth. Thus, smooth progress of the game is disturbed and the players may lose interest in the game.

Further, in the above-mentioned apparatuses, a number of dots or a number printed on a top side of a die is determined as a result of recognizing a pattern of an image of the numeral. A modification can be considered in which an image printed on each side of the die is altered or a shape of the die is altered from the cube shape into another shape, such as a pencil shape having a hexagonal cross section and 6 different images on the six sides thereof respectively (such as that shown in FIGS. 29B and 29D). If such a modification is performed on the die and the game apparatus should respond to the modification, it is necessary to substantially modify software programs for recognizing the images of the die, and thus costs for the modification are substantially large. Further, if a rather complicated image is used as an image on each side of the die, a substantially large amount of pattern recognizing software may be required. Thus, it can be said that the above-mentioned apparatuses are not very adaptive for a modification of a die such as altering an image on each side of the die. Further, in such a rolled number determining method as described above, an appropriate pattern recognition may be disturbed due to some stains on a surface of a die, a camera lens, a light or the like.

Further, Japanese Laid-Open Patent Application Nos.1-259888, 2-249574, and 2-249575 disclose game apparatuses. In the apparatuses, a rolled number of a die is not determined in a manner such as that mentioned above. By a method such as that in which a magnet is embedded in the die, it is possible to know a rolled number of a die before the die is thrown. However, in such a method, unexpectedness inherently included in a die game may be reduced and thus a player may lose interest in the game.

In order to solve the above-mentioned problems, the present applicant proposed 'a die-number reading system' in Japanese Laid-Open Patent Application No. 5-177056. In this system, each side of a die has converting means and a tag embedded therein. The converting means converts an identification number of a respective die number into an electromagnetic signal. The tag has a coil which emits the converted electromagnetic signal. A receiving coil provided in a surface on which the die is rolled receives the emitted electromagnetic signal. Thus, the identification number of the emitted electromagnetic signal is read and thus the relevant die number is determined.

However, in such a system, a respective tag provided in each side of a die has the above-mentioned converting means and electromagnetic-signal emitting coil and, in addition, has a power storing capacitor and storing means for storing a respective die number. Therefore, a construction of each tag is complicated and it is thus difficult to miniaturize, to reduce a weight of, and to reduce costs of the tag.

SUMMARY OF THE INVENTION

The present invention has been made so as to solve the above-mentioned problems, and an object of the present invention is to provide an apparatus for determining a part of an object. In this apparatus, it is possible, with a relatively simple method, to instantaneously, surely determine a part of an object. Further, a determination mechanism is not exposed to players, and the determination is possible even if an object is somewhat inclined or stains are present on a surface of the object.

An apparatus according to the present invention for determining a part of an object, comprises:

- an object having a plurality of parts, wherein each part of said plurality of parts can face a predetermined direction;
- a plurality of resonant circuits, mounted in different predetermined positions of said object, and having different resonance frequencies;
- sending means for sending signals having a plurality of frequencies corresponding to said resonance frequencies of said plurality of resonant circuits; and
- detecting means for detecting resonance signals of said plurality of resonant circuits.

In the apparatus, each resonant circuit resonates with its own resonance frequency in response to a signal having a frequency component corresponding to the resonance frequency of the resonant circuit. As a result, the resonant circuit sends a signal of the resonance frequency. The thus-sent signal is detected by the detecting means. In this case, the signal sent from the sending means attenuates due to a relevant propagation distance. Therefore, a resonant circuit located relatively near to the sending means can receive the signal at a relatively high signal level. Further, the signal sent from the resonant circuit as a result of the resonance also attenuates due to a relevant propagation distance. Therefore, the signal sent from a resonant circuit located relatively near to the detecting means can be received by the detecting means at a relatively high signal level.

Thus, due to difference in distances between the resonant circuits and the sending circuit and distances between the resonant circuits and the detecting circuit, levels of the signals detected by the detecting means are different. A case is considered in which the object having the plurality of resonant circuits provided at different positions therein faces along a direction. In this case, as described above, the signals sent from the sending means are used in the resonance in the resonant circuits, and are thus sent from the resonant circuits, the thus-sent signals being then received by the detecting means. These signals have frequency components corresponding to the resonance frequencies of the resonant circuits, and each of levels of the frequency components is different due to the direction along which the object faces.

With reference to FIG. 1, the above-described phenomenon will now be illustrated. FIG. 1 shows a principle of the present invention. A die D is placed on a plate P, and two resonant circuits R1, R2 having different resonance frequencies f1, f2 are embedded at opposite positions in the die D. In an example shown in FIG. 1, the die D is placed on the plate P in a position in which the resonant circuit R1 is located at a top position and the resonant circuit R2 is located at a bottom position by chance. Sending means T and detecting means S are provided below the plate P. A signal having frequency components of the frequencies f1 and f2 is sent from the sending means T upward. The signal is received by the resonant circuits R1 and R2 which then start resonating with their own resonance frequencies f1 and f2 respectively. The bottom resonant circuit R2 is located nearer to the sending means T than the top resonant circuit R1, and thus receives the signal from the sending means T at a relatively high level. As a result, the bottom resonant circuit R2 resonates at a relatively high level.

The resonating resonant circuits R1 and R2 send signals of the frequencies f1 and f2 with levels corresponding to the resonance levels respectively. As the bottom resonant circuit R2 resonates at the relatively high level as mentioned above, the level of the signal sent from the bottom resonant circuit R2 is relatively high in comparison to the level of the signal sent from the top resonant circuit R1. The sent signals are received by the detecting means S. In this case, the bottom resonant circuit R2 is located near to the detecting means S. Therefore, the signal sent from the bottom resonant circuit R2 is received by the detecting means S at a relatively high level in comparison to the signal sent from the top resonant circuit R1.

Thus, the bottom resonant circuit R2 receives the signal sent from the sending means T at the relatively high level and further the signal sent from this resonant circuit R2 is received by the detecting means at a relatively high level. As a result, the level of the signal sent from the bottom resonant circuit R2 and then received by the detecting means S is a higher level. Therefore, when analyzing frequency components of the signals received by the detecting means S, a level of the frequency component of the frequency f2 of the bottom resonant circuit R2 is higher than a level of the frequency component of the frequency f1 of the top resonant circuit R1.

If, differently from the position shown in FIG. 1, the die D is placed on the plate in a position in which the resonant circuit R2 is located at the top position and the resonant circuit R1 is located at the bottom position, a phenomenon inverse of that described above occurs. As a result, when analyzing frequency components of the signals received by the detecting means S, a level of the frequency component of the frequency f1 of the bottom resonant circuit R1 is higher than a level of the frequency component of the frequency f2 of the top resonant circuit R2.

Thus, by the apparatus according to the present invention, each of levels of frequency components of the resonance frequencies included in the signals received by the detecting means S is different due to a direction along which the die D faces. Using this phenomenon, it is possible to determine along which direction the die faces.

It is preferable that the apparatus further comprises;

a plate having therein said sending means and detecting means; and determining means for determining a part of said object placed on said plate, said part facing said predetermined direction, using differences of detected levels of said resonance signals of said plurality of resonant circuits of said object detected by said detecting means.

By using the apparatus, it is possible to immediately and surely determine a direction along which the object faces with a relatively simple system. Further, by selecting the resonance frequencies within a predetermined range, it is possible to make the relevant signals easily transmitted by the object and to make the plate on which the object moves of common materials. As a result, it is possible to embed the resonant circuits in the object and also to provide the sending means and detecting means below the plate. Thus, it is possible to prevent such a determining mechanism from being exposed to players. Further, even if stains are present on a surface of the object or the object is somewhat inclined, the determination is possible.

It is preferable that the apparatus further comprises control means for controlling said sending means and detecting means;

wherein:

said control means controls said sending means so that said sending means, sends, one at a time, signals having frequencies equal to said plurality of resonance frequencies of said plurality of resonant circuits, in a manner in which the signal of a resonance frequency is sent, sending is stopped for a predetermined time, and then the signal of a subsequent resonance frequency is sent; and said control means controls said detecting means so that, during a time in which said sending means stops sending the signal, said detecting means detects a reverberation oscillation of said plurality of resonant circuits which is caused by the signal sent immediately before, and compares a phase of the detected reverberation oscillation with a phase of said signal sent immediately before.

Thus, a respective signal sent from each of the resonant circuits is, one at a time, surely, analyzed. Thus, the sent signal can be effectively separated from the received signal and, thus, certain phase comparison can be performed. As a result, with a relatively simple system, it is possible to efficiently identify a resonant circuit located at a specific position.

It is preferable that said sending means includes an antenna comprising an electric wire forming at least one loop, and a formation of said antenna and said plurality of resonant circuits is such that each of said resonance frequencies of said resonant circuits is sufficiently low in comparison to a resonance frequency of said antenna and, as a result, a wavelength corresponding to said resonance frequency of said antenna is so short that said wavelength may be neglected in comparison to wavelengths corresponding to said resonance frequencies of said resonant circuits.

As a result, the antenna is prevented from oscillating itself with the resonance frequencies. Therefore, it is possible to improve a S/N ratio of signals received by the antenna, thus a positive measurement of the signal levels of the received signals, will occur to identify a resonant circuit located at a specific position.

An object according to the present invention, a part of which can be automatically determined, comprises:

a plurality of parts, wherein each part of said plurality of parts can face a predetermined direction; and a plurality of resonant circuits, mounted in different predetermined positions of said object, and having different resonance frequencies.

It is preferable that said object comprises a polyhedron and a respective one of said plurality of parts corresponds to each side of said polyhedron.

Thereby, when the object faces along each direction, a respective side of the object faces downward. Therefore, when the object is placed on a plane, a position of the object is stable in which the side faces the plane.

It is preferable that said plurality of parts can be visually identified by different numbers provided on said plurality of parts. As a result, players may identify each part of the object visually, clearly in a play.

It is preferable that a respective one of said resonant circuits is provided in each of said sides of said polyhedron. Thereby, when the object faces along a direction where a side of the polyhedron faces downward, the relevant direction can be surely determined.

It is preferable that said object comprises a plurality of objects. Thereby, by using a combination of object numbers of the plurality of objects as an object number, it is possible to increase the number of object numbers, and thus it is possible to increase player's interests on a relevant game.

It is preferable that each of said resonant circuits comprises a tank circuit comprising a coil and a capacitor, said plurality of resonance frequencies being different as a result of capacitances of the capacitors being different. Thereby, it is possible to realize an object direction determination system with a simple construction.

Thus, it is possible to provide the object suitable for the above-described apparatus for determining a part of the object, and thus surely provide the advantages of the determining apparatus.

Other objects and further features of the present invention will become more apparent from the following detailed description when read in conjunction with the accompanying drawings.

BRIEF DESCRIPTION OF THE DRAWINGS

FIG. 1 shows a principle of the present invention;

DETAILED DESCRIPTION OF PREFERRED EMBODIMENTS

A general construction of a dice game machine in a first embodiment using an apparatus for determining a part of an object according to the present invention will now be described with reference to FIGS. 2A, 2B and 2C.

Figure 2A:
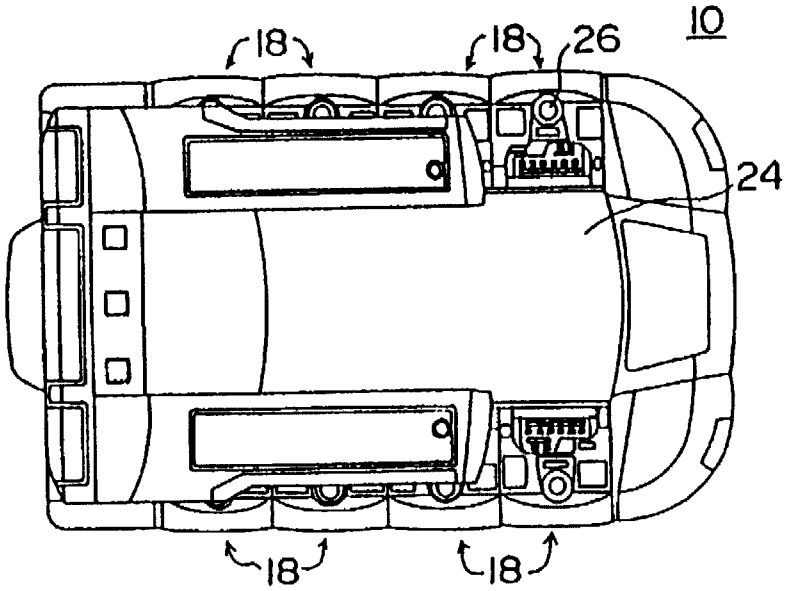
FIGS. 2A, 2B and 2C show an outline of a dice game machine in an embodiment of an apparatus for determining a part of an object.
Figure 2B:
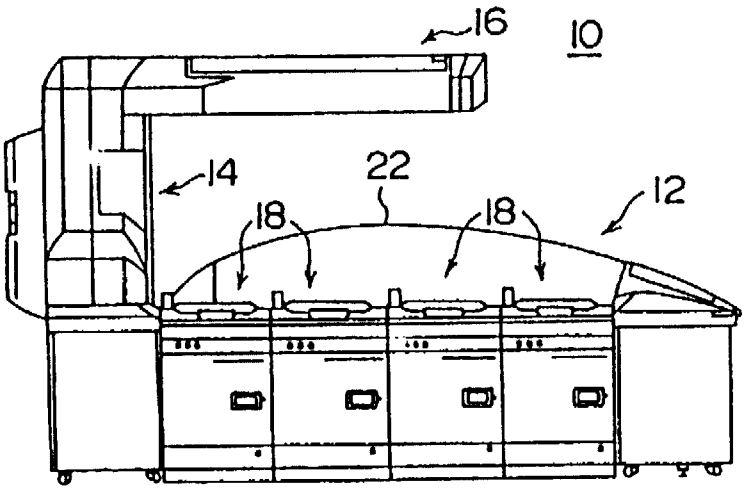
Figure 2C:
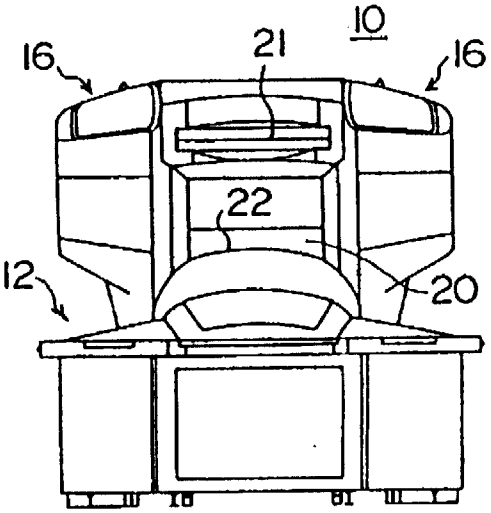

FIG. 2A shows a plan view of the dice game machine 10 using the present invention, FIG. 2B shows a side elevational view thereof, and FIG. 2C shows a front view thereof. The dice game machine 10 is a game machine such as that placed in an amusement facility such as a game center. The machine 10 includes a body 12, a screen unit 14 standing at the rear of the body 12, and a light unit 16 forward extending from the screen unit 14. The body 12 is provided with a total of eight satellites (game stations) 18, four at the left and four at the right, so a plurality of players may simultaneously play a game. Each satellite is provided with various operation switches, a display device, and so forth necessary for playing a game. Each player plays a game that is present in front of a respective one of the satellites 18. The screen unit 14 is provided with a display 20 which may display how a game is going on, rules of the game and so forth. A dot display unit 21 is provided above the display 20 for displaying a rolled number of a die. The light unit 16 horizontally extends from the top of the screen unit 14, lights the body 12 and satellites 18 from the top and thus enhances an ornamental effect.

A center part of the body 12 sandwiched by the left and right satellites 18 is covered by a transparent dome 22. Inside the dome 22, a field 24 having a wide level plane for the die to roll thereon. A surface of the field 24 is provided with, for example, a green felt sheet stuck thereon.

A general playing method of the game machine 10 will now be described. A general game flow is that each of a plurality of players guesses a rolled number of the die; one of the players throws the die through a device, referred to as a shooter; and a game result for each player is determined based on a resulting actual rolled number of the die.

In detail, each player stands (or sits down) in front of a respective one of the satellites 18. Then, each player inputs his or her intention to participate in a game to the machine 10 and thus the machine 10 gives guidance of the game by supplying a predetermined display on the display device of a respective one of the satellites 18. Then, each player follows the guidance, such as guessing rolled numbers of two dice, and inputs the guessed rolled numbers of the dice into the machine 10.

The dice game machine 10 then automatically selects one satellite from among the satellites 18, which are engaged by the plurality of players. Thus, one player is selected from among the plurality of players to be the shooter. In this game, in order to providing fairness, this selection is performed using a method such as, for example, a random number calculation or the like. As a result of the selection operation, the dice game machine 10 lights a lamp of a shooting button 26 of the selected satellite and thus urges the relevant player to hit the shooting button 26. The shooting button 26 is a lighting button which is provided with the lamp therein and each satellite is provided with a relevant one thereof. The thus-selected shooter (the selected player) hits the relevant shooting button 26 with his or her hand. By this hitting operation, the two dice (not shown in the figures) which were previously set in a shooting mechanism provided at the right end in FIG. 2B of the field 24 are shot by the shooting mechanism from a front side of the field (a reverse side of the screen unit 14).

Acceleration given to the two dice in the shooting operation by the shooting mechanism varies depending on an intensity with which the shooter (selected player) hits the shooting button 26. Specifically, when the shooter hits the button 26 strongly, the dice are shot strongly. When hit weakly, the dice are shot weakly. Thus, the shooter may adjust the hitting intensity in an attempt to have his or her mind so that his or her guessed rolled numbers of the dice be actually rolled.

In order to realize such dice shooting acceleration control, a hitting intensity detecting mechanism is provided. In order to realize the hitting intensity detecting mechanism, for example, a projection is provided at the bottom surface of the shooting button 26 and a force receiving unit is provided below the projection. When the button 26 is hit, the projection hits the force receiving unit. A well-known piezoelectric device may be used in the force receiving unit which is used to convert a hitting intensity applied to the shooting button 26 into an electric signal when the shooting button 26 is hit by the shooter. Thus, such a hitting intensity is determined by the dice game machine 10.

The thus-shot two dice roll on the field due to the given acceleration, and then naturally stop. In this game machine, as above, a number of a side facing upward of each die which has thus stopped is referred to as a 'rolled number' of the die. The field 24 on which the dice thus roll is located at a position at which each player standing in front of a relevant satellite can directly look via the transparent dome 22, as shown in FIG. 2A. As a result, each player can in real time recognize an operation of the dice and resulting actual rolled numbers thereof.

The dice game machine 10 is provided with a rolled number determining system for instantaneously determining an actual die rolled number. An apparatus for determining a part of an object according to the present invention is applied to this rolled number determining system. By the rolled number determining system, when a movement of a die 1 (see FIG. 25A) stops, the rolled number determining system can determining a current rolled number of the stopped die 1 approximately at the same time each player visually recognizes the current rolled number of the stopped die 1.

The rolled number determining system will now be described in general. The system includes a combination of a plurality of transponders 4 (see FIG. 25A) embedded in the die and an antenna 24*a* (see FIGS. 17 and 26B) laying beneath a felt sheet 24*c* of the field 24. The antenna 24*a* is included in a detecting unit 220 connected to a field control unit 200 shown in FIG. 3A. The detecting unit 220 has, in addition to the antenna 24*a*, a control unit 221, a sending unit 222, and an analyzing unit 223 (see FIG. 17). Either the sending unit 222 or analyzing unit 223 is connected to the antenna 24*a* and the control unit 221 is connected to a main control CPU 210 in the field control unit 200 via an input/output control I/F (see FIGS. 3 and 17).

Each of the plurality of transponders is formed of a resonant circuit in the apparatus for determining a part of an object according to the present invention. The antenna 24*a* and the sending unit 222 act as sending means in the apparatus for determining a part of an object according to the present invention. The antenna 24*a* and analyzing unit 223 act as detecting means in the apparatus for determining a part of an object according to the present invention. The control unit 221 acts as determining means in the apparatus for determining a part of an object according to the present invention.

The sending unit 22 emits predetermined electromagnetic waves via the antenna 24*a*. An electromagnetic wave of a specific resonance frequency then send by a transponder (tag) which is located at a position nearest to the antenna 24*a* is then received by the antenna 24*a*. Thus, a die number corresponding to this transponder is determined. In each side of the die, a transponder representing a die number relevant to the side is embedded. A different resonance frequency is assigned to each transponder. A transponder which is embedded in a side (bottom side) sends a signal of a frequency relevant to a die number of an opposite side (top side). A thus-sent electromagnetic wave is received by the antenna 24*a* and analyzed by the analyzing unit 223. Thus, the relevant die number is determined as a relevant rolled number of the die.

The dice game machine 10 uses the two dice. Therefore twelve transponders having different resonance frequencies representing each side of each of the two dice are necessary to be provided. Six of the twelve transponders are embedded in six sides of one die, respectively, and six thereof are embedded in six sides of the other die, respectively. Actually, not only a relevant transponder but also the other transponders send electromagnetic waves of their own resonance frequencies. However, by providing the antenna 24*a* having a construction such that the relevant transponder which is one embedded in the bottom side of the die is received by the antenna with an especially high level, a relevant die number can be determined as a relevant rolled number.

A structure of each of the transponders will now be described further in detail. Each of the transponders is formed of a tank circuit of a parallel circuit of a coil and a variable-capacity capacitor for forming a resonant circuit. By differing capacitances of such variable-capacitance capacitors from one another, it is possible to differ resonance frequencies of the transponders from one another. Thus, it is possible to use coils and variable-capacitance capacitors of the same standards for the plurality of transponders, and thus the transponders are economically provided.

From the antenna 24*a*, electromagnetic waves of the resonance frequencies of the twelve transponders are send one by one. Then, the analyzing unit 223 analyzes electromagnetic waves sent from the transponders in response to the electromagnetic waves sent from the antenna 24*a*. Frequencies which are obtained as a result of the analyzing are those of two transponders which are embedded in the bottom sides of the two dice. As mentioned above, for the two transponders, the frequencies represent dice numbers of the opposite sides, that is, the top sides. Consequently, the dice numbers represented by the obtained frequencies are the rolled numbers of the dice.

Because the dice game machine 10 uses the above-described rolled number determining system, a simple and accurate rolled number determination can be realized, in comparison to conventional methods in which image recognition is performed for recognizing rolled numbers. Further, it is possible to inexpensively provide a rolled number determining system.

The dice game machine 10, after thus determining rolled numbers of the dice, compares the thus-determined numbers with guessed rolled numbers which were previously input. The machine 10 determines a game result for each player based on a result of the comparison, agreement or disagreement. Further, based on determined game results, the machine 10 automatically performs point allotment calculation and so forth depending on points which were previously set by each player.

Terms 'point setting', 'point allotment' of points and 'already-allotted points' used in the present specification will now be described. Each player sets a numerical weight on his or her guess of rolled numbers of the dice by 'setting points'. Then, after a game has been finished, a numerical evaluation is given to each player as a result of 'allotting points' depending on the thus-set numerical weight of the point setting and a game result. The thus-allotted points are the 'already-allotted points'. A concept to be used for performing such a numerical evaluation is not limited to the 'points'. Any other concept which is one usable for the same purpose can be used, instead. By using such a numerical concept, it is possible to advantageously give complexity to a relevant game. It is possible to enhance a calculation ability of a person who merely participates in the game.

After a first game operation has been thus finished, the dice game machine 10 then automatically collects the two dice on the field 24 through a collecting mechanism to the above-mentioned shooting mechanism, thus preparing for a subsequent game operation. A time required for the dice collection is approximately 25 to 30 seconds and, during the time, each player inputs a rolled number guess for the subsequent game operation and so forth. Then, the dice game machine 10 selects a subsequent shooter (one of the players) and lights a shooting button 26 of a relevant satellite, thus urging the shooter to hit the button. Thus, a similar game operation is repeated.

Such shooter selection may be performed in a manner in which the shooter is shifted to a next player sequentially from the first selected player, and thus a relevant instruction display is performed on a relevant satellite. However, a selection method is not limited to this manner. For example, it is also possible to select as a subsequent shooter the player who gained the highest number of points allotted in the preceding game operation.

Figure 3A:
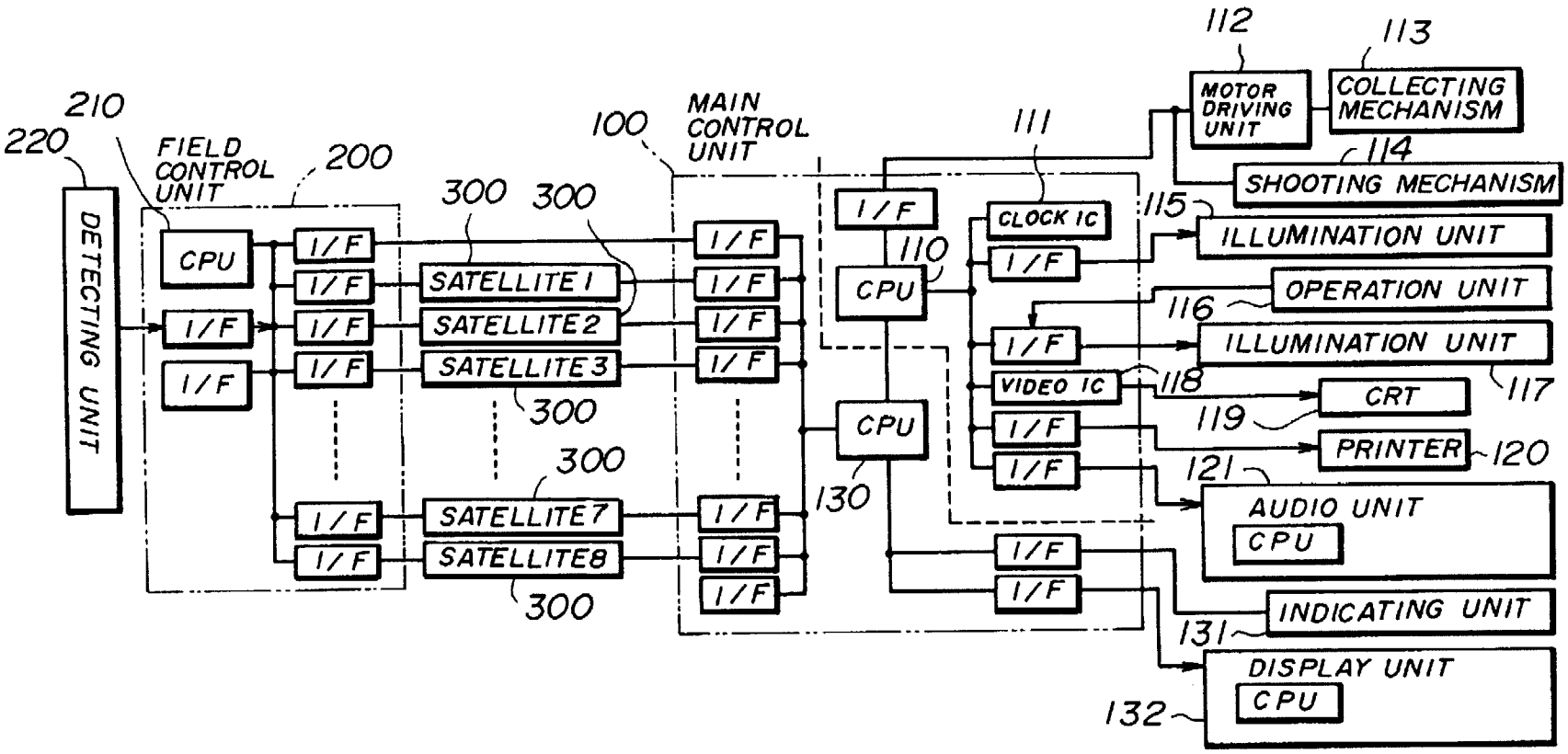
FIGS. 3A and 3B show block diagrams of a control system of the dice game machine shown in FIGS. 2A, 2B and 2C.
Figure 3B:
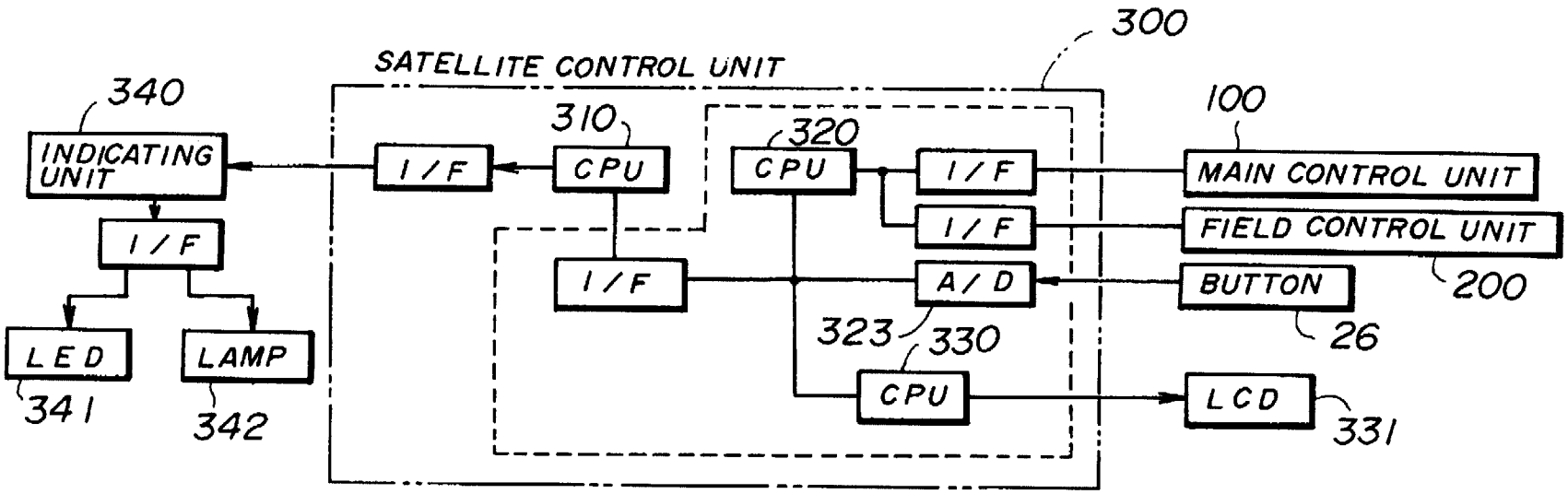

With reference to FIGS. 3A and 3B, the control system of the dice game machine 10 will now be described. FIG. 3A shows a block diagram of the inside and periphery of a main control unit 100 and the above-mentioned field control unit 200. FIG. 3B shows a block diagram of the inside and periphery of a satellite control unit 300 of eight satellite control units 300 having identical formations.

With reference to FIG. 3A, in general, the control system includes the main control unit 100, field control unit 200 and control units 300 provided for eight satellites 18 respectively. These control units are formed on a main control substrate, a field control substrate, and satellite control substrates, respectively.

The main control unit 100 has two main CPUs (Central Processing Units) 110 and 130 cooperatively, generally controlling operations of the main control unit 100. These main CPUs are connected with each other. The main CPU 130 is connected to a main control CPU 210 of the field control unit 200 via an optical communications unit including an optical cable and communications control IC (Integrated Circuit) I/Fs provided at two ends of the optical cable. Further, the main CPU 130 is connected to a sub-CPU 320 of each satellite control unit 300 via an optical communications unit similar to the above-mentioned one (see FIG. 3A). Further, the main CPU 130 is connected to an indicating unit 131 and a display unit 132 via input/output control IC I/Fs, respectively.

Further, the main CPU 110 is connected to a motor driving unit 112 and the shooting mechanism 114 via an input/output control IC I/F. Further, the motor driving unit 112 is connected with the collecting mechanism 13. Further, the main CPU 110 is connected to a clock IC 111, to an illumination unit 115 via an input/output control IC I/F, and to an operation unit 116 and an illumination unit 117 via an input/output control IC I/F. Further, the main CPU 110 is connected to a CRT (Cathode Ray Tube) 119 via a video IC 118. Further, the main CPU 110 is connected to a printer 120 and an audio unit 121 via input/output control IC I/Fs. In the above-mentioned connections, connections of the illumination units 115, 117, and display unit 132 with relevant input/output control IC I/Fs are made via optical communications units similar to the above-mentioned one.

The field control unit 200 has a main control CPU 210 for generally controlling the control unit 200. The main control CPU 210 is connected to the sub-CPU 320 of each satellite control unit 300 via an optical communications unit similar to the above mentioned one. Further, the main control CPU 210 is connected to the above-mentioned detecting unit 220 via an optical communications unit similar Each one above mentioned one.

Each one of the satellite control units 300 has a main CPU 310, two sub-control CPUs 320 and 330 for cooperatively, generally controlling the respective control unit 300. The two sub-CPUs 320 and 330 are connected to each other and also connected to the main CPU 310 via an input/output control IC I/F. The sub-CPU 320 is further connected to the shooting button 26 via an A/D converter 323. Further, the other sub-CPU 330 is connected to an LCD (Liquid Crystal Display device) 331. Further, the main CPU 310 is connected to an indicating unit 340 via an optical communications unit similar to the above-mentioned one, and the indicating unit 340 is connected to an LED (Light-Emitting Diode) 341 and a lamp 342 via an input/output control IC I/F.

Thus, the optical communications units are used appropriately so that signal transmissions between relevant units may be made high speed.

Figure 4:
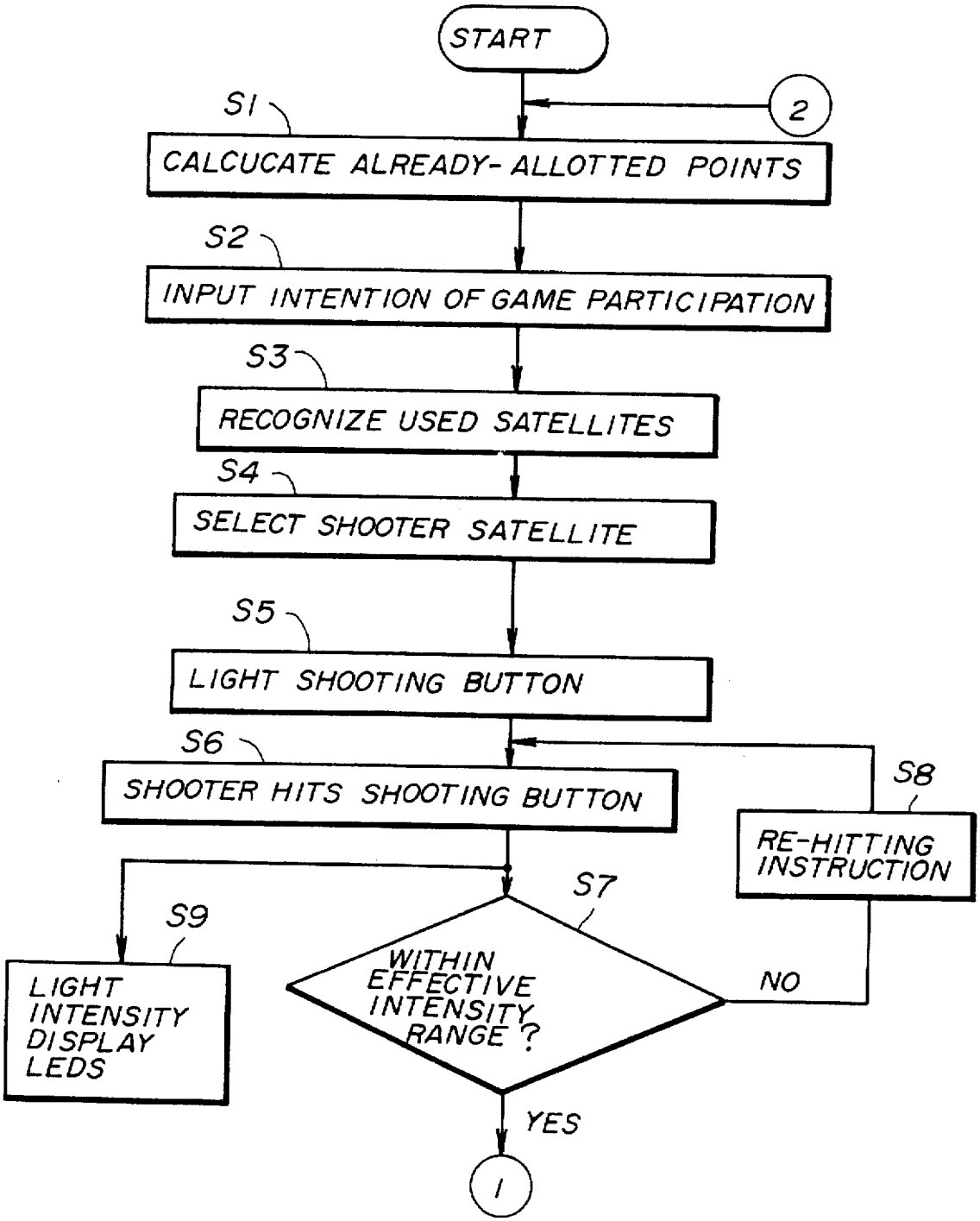
FIGS. 4 and 5 show a flowchart showing a general operation of the dice game machine shown in FIGS. 2A, 2B and 2C.
Figure 5:
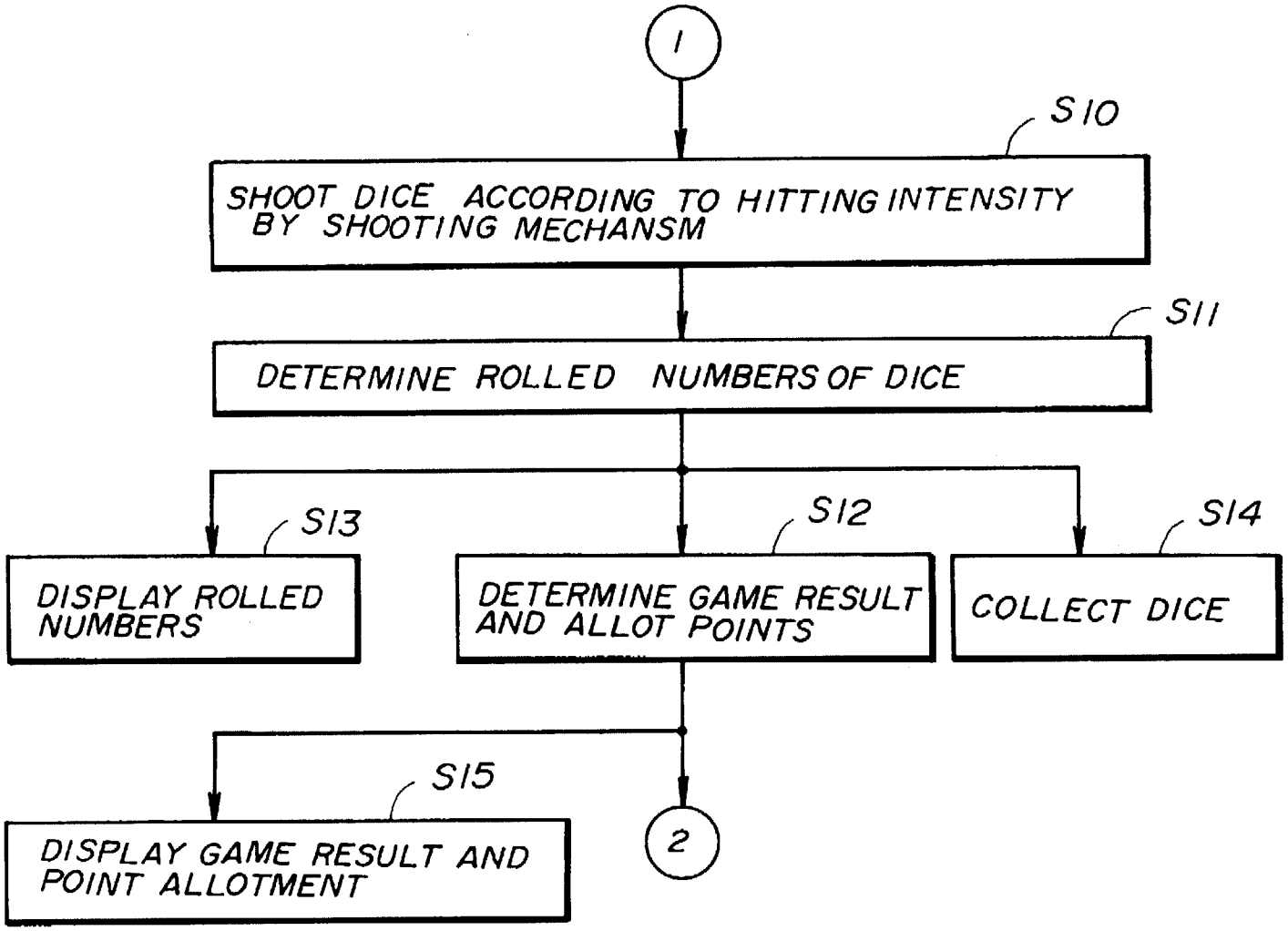

Operations of the above-described control system will now be described with reference to FIGS. 4 and 5. FIGS. 4 and 5 shows a flowchart of a main operation of the dice game machine 10.

The main CPU 130 of the main control unit 100 uses the display unit 132, which itself also has a CPU for performing video control, and thus appropriately displays, through the display 20 shown in FIG. 2A, general information such as rules, progress and so forth of a game. Further, the main CPU 110 uses the two illumination units 115 and 117 and thus produces illuminations provided in the light unit 16 shown in FIG. 2A in accordance with a predetermined program. Further, various audio signals, music and so forth are output in accordance with a predetermined program through the audio unit 121 using MIDI (Musical Instrument Digital Interface). Such visual appeal and auditory appeal may enhance each player's enjoyment of the game through the dice game machine 10. Furthermore, a person who is merely present near the dice game machine 10 may develop interest in the dice game machine 10.

Further, the operation unit 116, CRT 119 and printer 120 connected to the main control unit 100 are used mainly for a maintenance work for the dice game machine 10. For example, servicemen use them for checking how the machine has been used.

In a step S2 (a term 'step' will be omitted, hereinafter), each player inputs his or her intention of participating in a relevant game. In response to this, a relevant one of the satellite control units 300 transmits the relevant information to the main CPU 130 in the main control unit 100 via a relevant one of the sub-CPUs 320. Thereby, the CPU 130 recognizes with which satellite 18 a player is engaged in S3. The indicating unit 310 of each satellite 18 is provided with a numeral indicating device for indicating already-allotted points and set points with a combination of LEDs, and indicates the player's already-allotted points and set points.

Setting points for a play of the game will now be described. The sub-CPU 320 determines already-allotted points for a relevant player and indicates a guidance in the LCD via the sub-CPU 330 for the player to set points. In response to this, the player sets points for the play by pressing setting buttons provided on the satellite. Then, thus-input setting information is transferred to the main CPU 310 which then indicates the set points on the above-mentioned numeral display device of the indicating unit 340. Further, when a preceding play of the game has been finished and point allotment therefor has been finished, the main CPU 310 calculates a resulting already-allotted points for each satellite in S1. The main CPU 310 determines for each satellite that a player is engaged with the satellite as long as relevant allotted points have not yet become zero.

Each one of the sub-CPUs 330 indicates on the relevant LCD 331 information of game progress and gives a guidance for the play of the game for the relevant player. Then, according to a predetermined program, the main CPU 130 of the main control unit 100 selects a satellite as a shooter in S4. The main CPU 130 then transfers relevant information to the satellite control unit 300 of a thus-selected satellite. In response to this, the sub-CPU 320 of the satellite control unit 300 having received the transferred information transfers, via the main CPU 310, information for instructing the indicating unit 340 to light the lamp 3432 provided inside the shooting button 26. As a result, the indicating unit 340 lights the lamp 342 in the shooting button 26 in S5.

Then, the shooter (selected player) hits the shooting button 26 in S6, and thus the above-mentioned hitting-intensity detecting mechanism converts the hitting intensity into an electric signal which is then transferred to the A/D converter 323. The A/D converter 323 converts the electric signal into a digital signal and sends it to the main CPU 310. The main CPU 310, according the digital signal, lights a number of LEDs, depending on the hitting intensity, of hitting intensity display LEDs provided around the shooting button 26, in S9.

Further, it is preferable that, as the shooting button of the selected satellite is lit, the main and sub-CPU 310 and 320 function so that a signal generated from a voltage signal generating unit 60 of each of the shooting buttons of the other satellites is invalidated. As a result, even if a player other than the shooter erroneously hits his or her own shooting button, relevant ones of the hitting intensity display LEDs may not be lit and also the shooting mechanism may not operate in response to this erroneous hitting.

Figure 6:
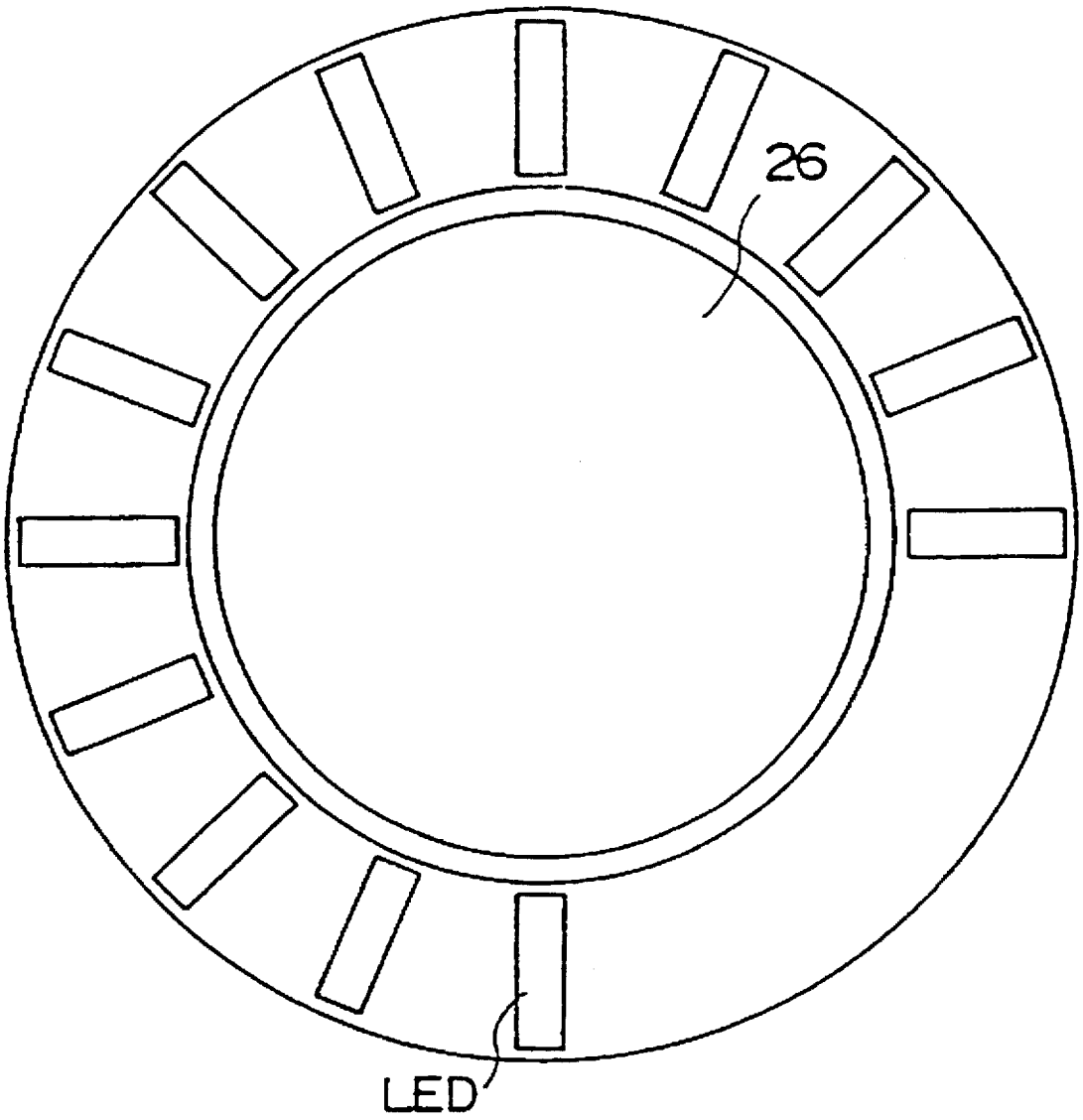
FIG. 6 shows a plan view of a hitting intensity display LED provided to each satellite of the dice game machine shown in FIGS. 2A, 2B and 2C.

FIG. 6 shows an arrangement of the hitting intensity display LEDs provided around the shooting button 26 of each satellite 18. As shown in the figure, the plurality of LEDs are arranged along radial directions. Approximately immediately after the shooting button 26 is hit by the shooter, a number of LEDs depending on the hitting intensity are lit. Therefore, the shooter can recognize the hitting intensity immediately after the hitting and thus it is possible to increase the player's interest in the game.

Only when it is determined in S7 that the hitting intensity applied to the shooting button 26 at the hitting thereof is within an effective intensity range, it is possible to vary acceleration given to the dice in accordance with the hitting intensity. If the shooting button 26 has been hit with an intensity stronger than the upper limit of the effective intensity range, the maximum limit of an ability of the shooting mechanism for giving acceleration to the dice will be reached. Therefore, it is not possible to further increase an acceleration to be given to the dice even if the shooter hits the shooting button 26 with stronger intensity. However, a life time of the shooting button 26 may be shortened.

In contrast to this, if the shooter hits the shooting button 26 with an intensity less than the lower limit of the effective intensity range, the shooting mechanism does not shoot the dice. This is because if the shooting mechanism gives to the dice a very small acceleration, the dice may not be appropriately shot, and may roll slightly and then stop soon. If such an operation is possible, the shooter may control rolled numbers of the dice. As a result, players'interest for the game may be decreased.

Therefore, an appropriate program is set to the main CPU 110 of the main control unit 100 shown in FIG. 3A for controlling the shooting mechanism 114 such that an operation of the shooting mechanism 114 giving such a very small acceleration to the dice is inhibited. Thus, an intensity in hitting the shooting button 26 should be within the effective intensity range and thus the dice may be shot with an appropriate acceleration. The hitting intensity display LEDs shown in FIG. 6 are advantageous for appropriately using the shooting mechanism's function. For this purpose, a number of LEDs may be relevant to the effective intensity range. Specifically, one or zero of the LEDs is lit when the shooting button 26 has been hit with the lowest intensity of the effective intensity range. When the button 26 has been hit with the maximum intensity of the effective intensity range, all of the LEDs are lit. Thereby the shooter can visually recognize the effective intensity range and thus can control a hitting intensity to be within the effective intensity range. Thus, the shooter can easily control the hitting intensity.

During a time when no play is performed on the dice game machine 10, that is, when the machine 10 is waiting for a player, the LEDs shown in FIG. 6 function as illuminations and are lit by the main CPU 310 according to a predetermined program.

A program for controlling the shooting mechanism includes steps which will now be described. When it is determined in S7 that the shooter hits the shooting button 26 with an intensity lower than the lowest limit of the effective intensity range, the dice game machine 10 indicates, in S8, on the LCD 331 of the relevant satellite, contents for instructing the shooter to again hit the shooting button 26 with a stronger intensity. Further, if the shooting button 26 is not hit with a predetermined time, the shooting mechanism is controlled so that the shooting mechanism automatically shoots the dice so as to give a predetermined acceleration to the dice. Thereby, it is prevented that other players wait for a long time and thus lose interest in the game.

When the shooter hits the shooting button 26, information indicating the hitting intensity is converted into a digital signal by the A/D converter 323. The digital signal is then transferred to the main CPU 130 of the main control unit 100 via the sub-CPU 320. This information is then transferred to the main CPU 110 which then controls the shooting mechanism 114 to shoot the dice with an intensity relevant to the shooter's hitting intensity. As a result, the shooting mechanism 114 shoots the dice and gives a relevant acceleration to the dice, in S10. The dice thus shot from the shooting mechanism 114 provided at the right end of the field 24 shown in FIG. 2B then fly using the given acceleration above the field 24. Then, the dice fall on the field 24 either after colliding with a wall provided at the left end of the field 24 or directly. The dice may roll and then stop.

When the shooter hits the shooting button 26, relevant information is transferred to the main control CPU 210 of the field control unit 200 from the relevant satellite. In response to this, the main control CPU 210 causes the detecting unit 220 to operate. The detecting unit 220, using the above-mentioned rolled number determining system, determines rolled numbers of the two stopped dice on the field 24, in S11. Information of the thus-determined rolled numbers of the dice is transmitted to the main CPU 130 of the main control unit 100 via the main control CPU 210 of the field control unit 200. Then, the transmitted information is transmitted to the indicating unit 131 having the dot display unit 21 shown in FIG. 2C. Then, the determined rolled numbers are indicated on the dot display unit 21, in S13. Further, the main CPUs 110 and 130 determine a game result for a player of each satellite according to the rolled number information, and perform point allotment according to the determined game result, in S12. Further the game results and point allotment are displayed on the display 20 through the display unit 132.

Further, when the rolled number determination by the detecting unit 220 connected to the field control unit 200 has been finished, the main control CPU 210 transmits relevant information of the finishing to the main CPU 110 of the main control unit 100. In response to this, the main CPU 110 causes the collecting mechanism 112 to operate and thus collects the two dice on the field 24 and returns them to the shooting mechanism automatically, in S14. Further, in order to enable starting of a subsequent play of the game, the main CPU 110 indicates a guidance for the subsequent play of the game on the display 20 via the display unit 132 and further on the LCD 331 via the sub-CPUs 320, 330 of each satellite control unit 300. Then, the dice game machine 10 starts calculation of already-allotted points for each satellite, repeats the above-mentioned operations, and thus proceeds with the game playing.

The numbers and functions of the main and sub-CPUs 110, 130, 210, 310, 320, and 330 are not limited to those mentioned above, and may be freely altered as long as the above-mentioned functions of the dice game machine 10 are generally performed. However, it is preferable that those matters are determined with consideration of a data processing capability of each CPU, functions of peripheral units connected to the CPU, and so forth. Thus, it should be prevented that a smooth progress of the game is disturbed by a time required for executing each step by the CPU, a time required for transmitting a signal between CPUs and so forth.

The above-mentioned shooting mechanism 114 will now be described.

Figure 7:
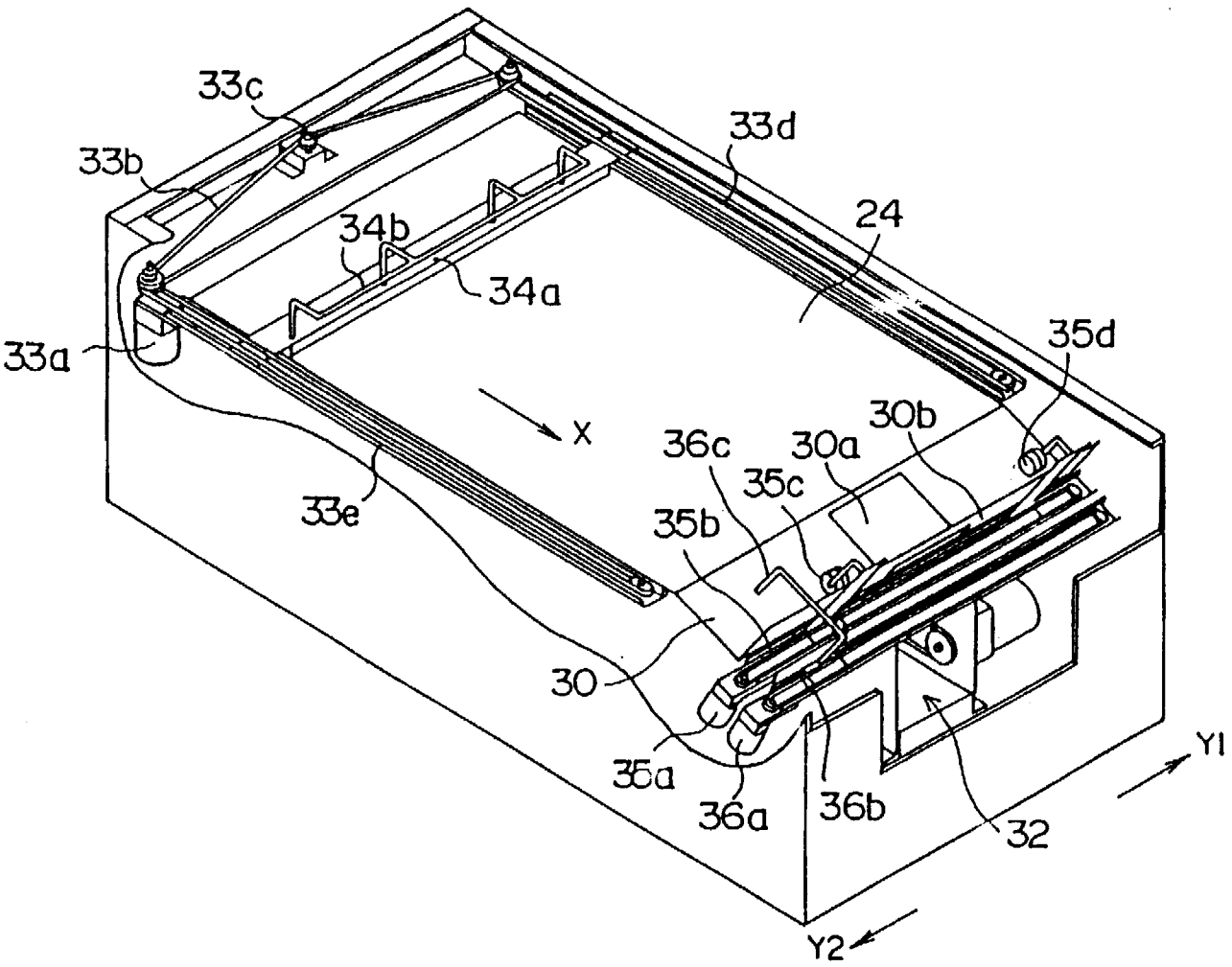
FIG. 7 shows an exploded view of a collecting mechanism of the dice game machine shown in FIGS. 2A, 2B and 2C.

FIG. 7 simply shows a perspective view of the inside of the body 12 of the dice game machine 10 shown in FIGS. 2A, 2B and 2C. The above-mentioned shooting mechanism 114 and the collecting mechanism 113 are provided around the field 24. The front part of the field 24 is connected to an inclined portion 30, and the dice shot on the field 24 are moved by the collecting mechanism 113 to the inclined portion 30. The two dice which have reached the inclined portion 30 slide down on the inclined portion 30, and then are collected by the collecting mechanism 113 to the center. At the center of the inclined portion 30, a shooting plate of the shooting mechanism 114 is positioned. Therefore, the two center-collected dice are placed on the shooting plate. FIG. 7 shows a state in which the shooting mechanism 114 is removed. However, the shooting mechanism 114 (see FIGS. 8 and 9) is normally mounted in a space 32 shown in FIG. 7.

Figure 8:
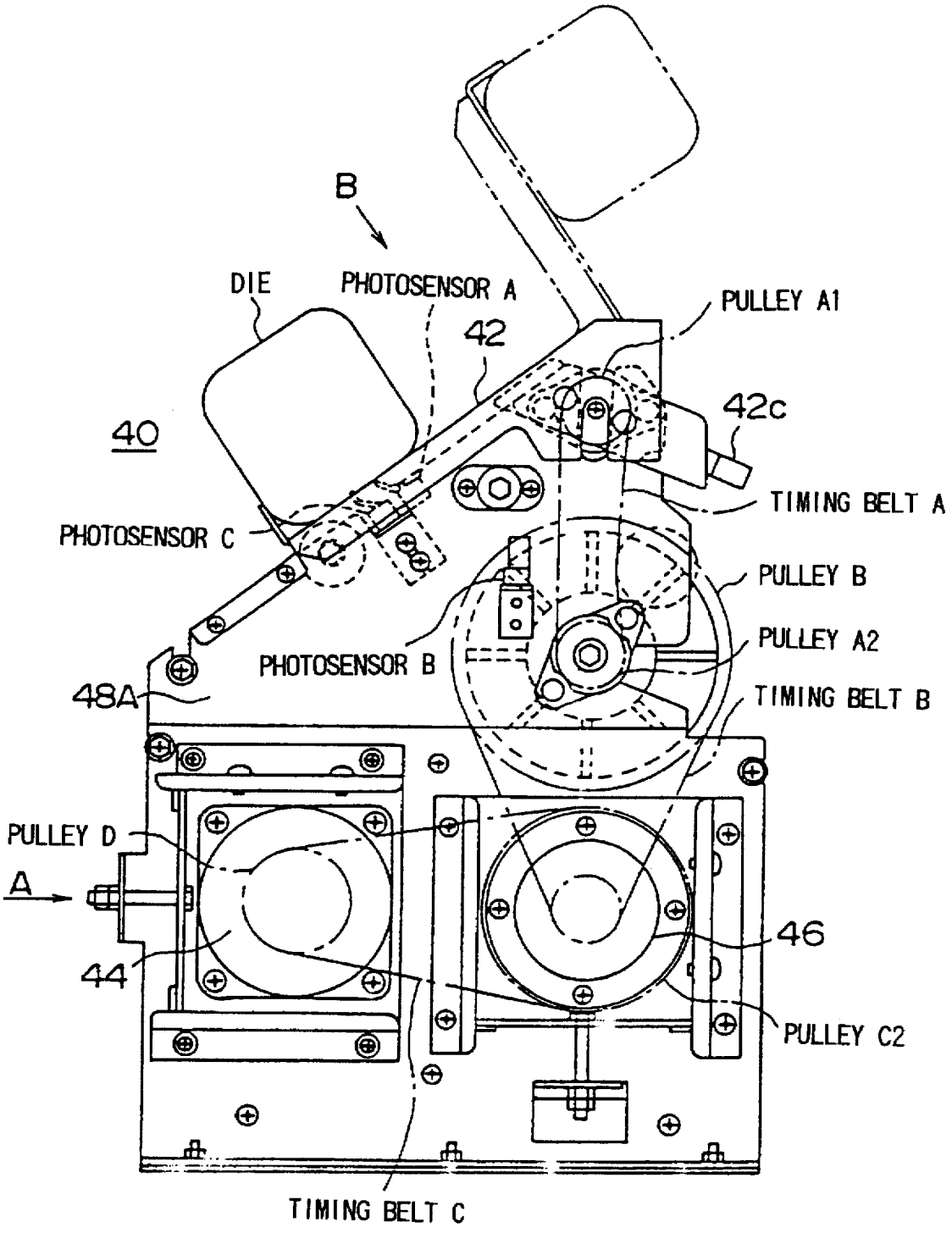
FIGS. 8, 9, 10 and 11 show a shooting mechanism of the dice game machine shown in FIGS. 2A, 2B and 2C.
Figure 9:
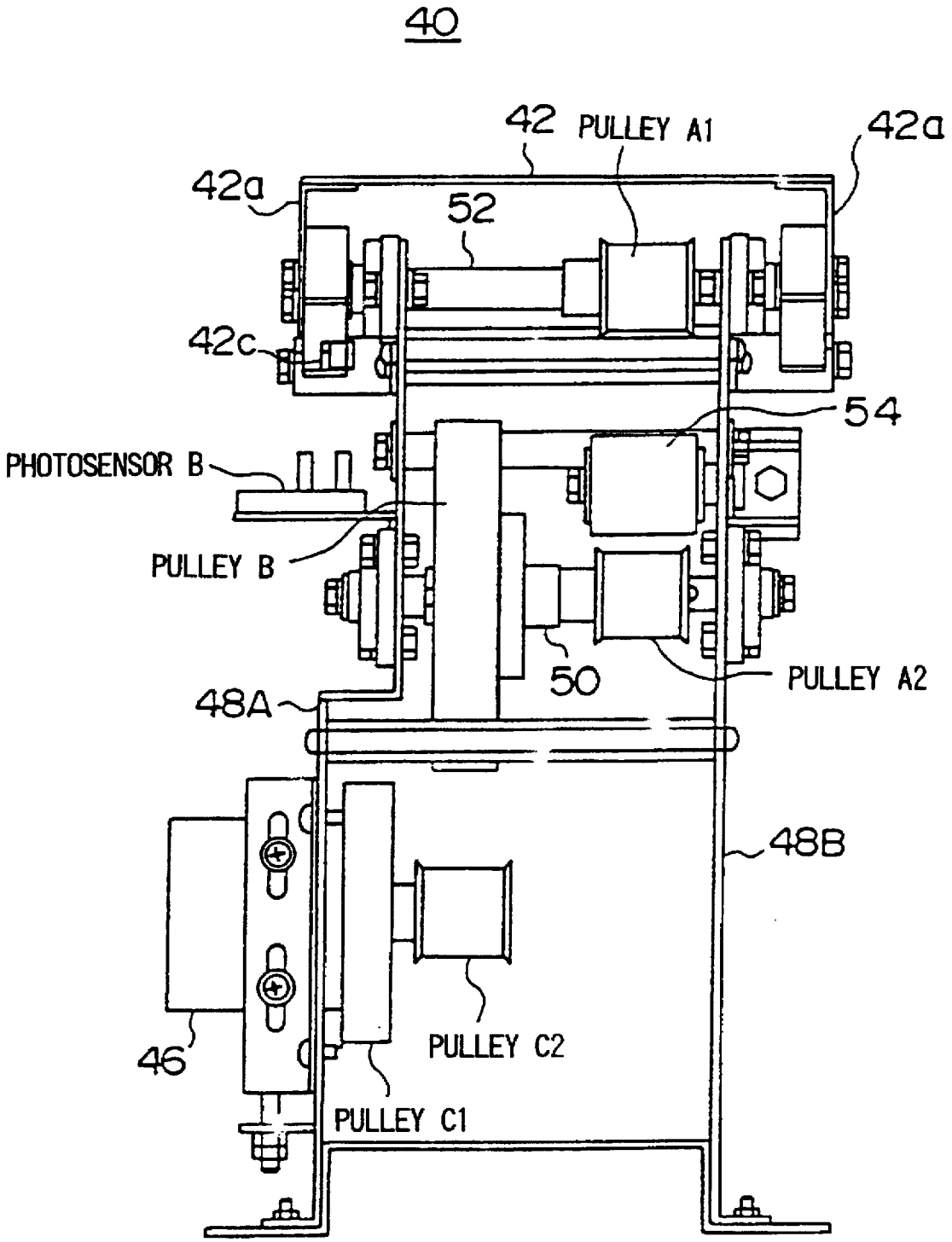
Figure 10:
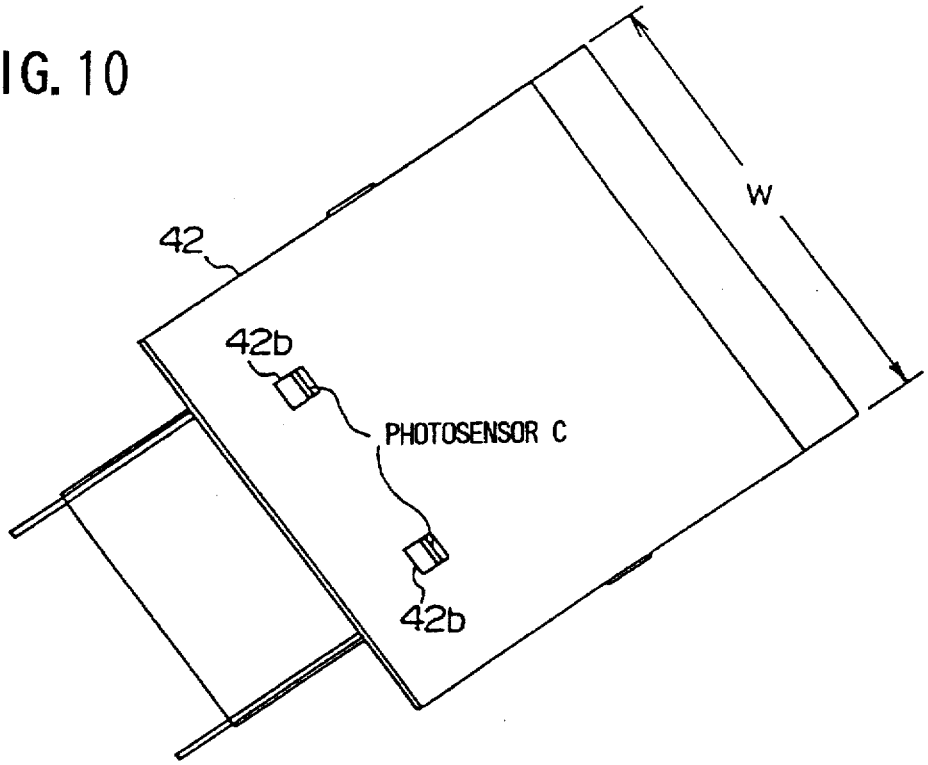
Figure 11:
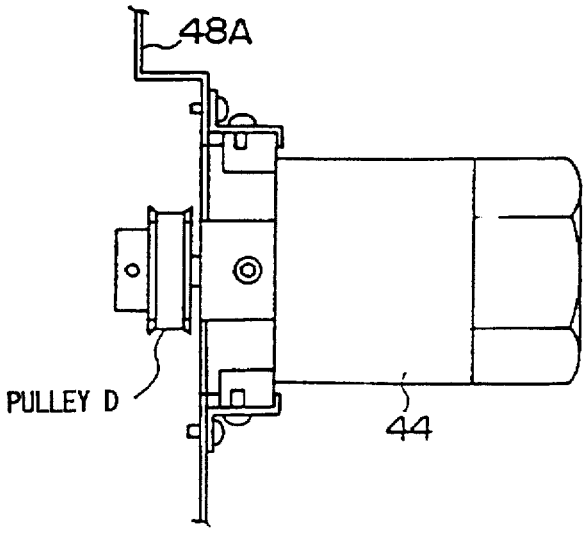

FIG. 8 shows a side elevational view, and FIG. 9 shows a front view of the shooting mechanism 114. Further, FIG. 10 shows a partial view viewed along an arrow B shown in FIG. 8, and FIG. 11 shows a partial view viewed along an arrow A shown in FIG. 8. The shooting mechanism 114 is a unit type, and the entirety thereof can be drawn out from the body 12 of the dice game machine 10. Accordingly, maintenance and repairing thereof may be easily performed.

The shooting mechanism 114 includes the above-mentioned shooting plate 42, a driving AC motor 44, an electromagnetic powder clutch 46 for adjusting power transmission for the AC motor 44, and pulleys and timing belts as power transmission mechanisms for these components.

The AC motor 44 and electromagnetic powder clutch 46 are mounted on a side plate 48A. As shown in FIG. 11, a pulley D is mounted on a driving shaft of the AC motor 44. Further, a pulley C2 is mounted on a power input side of the electromagnetic powder clutch 46 and a pulley C1 is mounted on a power output side thereof. A timing belt C links the pulley D of the AC motor 44 with the pulley C2 of the electromagnetic powder clutch 46.

Above the electromagnetic powder clutch 46, a shaft 50 is rotatably supported between the side plate 48A and another side plate 48B. The shaft 50 has a pulley B and a pulley A2 mounted thereon. The pulley B is positioned vertically above the pulley C1 of the power output side of the electromagnetic power clutch. These pulleys are linked by a timing belt C. The diameter of the pulley B is larger than the diameter of the pulley C1 and thus a predetermined speed reduction ratio can be obtained thereby. A tension of the timing belt is adjusted as a result of either the AC motor 44 or the electromagnetic powder clutch 46 moving slightly.

Vertically above the shaft 50, a shaft 52 is rotatably supported between the side plate 48A and the other plate 48B, similarly to the shaft 50. A pulley A1 is mounted on the shaft 52, and a timing belt A links the pulley A1 with the pulley A2 of the shaft 50. A tension of the timing belt A can be adjusted as a result of pressing a part between the pulley A1 and pulley A2 with an idle roller 54. Accordingly, it is necessary to provide an adjusting mechanism such as an idle pulley for adjusting the tension of the timing belt A. As a result, assembly can be easily performed and also it is possible to reduce a number of components.

Two ends of the shaft 52 extend from the side plates 48A and 48B, and an angular-C-shaped portion 42*a* of the shooting plate 42 is fixed on these two ends. The shooting plate 42 is, ordinarily, in an inclined state shown in FIG. 8 by a solid line, and this state is determined using a photosensor A. This photosensor A is one of a type having a rotating lever, and, as a result of the lever being rotated and thus moved to a predetermined position as a result of the lever touching a part of the shooting plate 42, a light path is blocked and the photosensor outputs a relevant signal. As shown in FIG. 8, the photosensor A is provided at the bottom side of the shooting plate 42.

A width W of the shooting plate 42 is approximately equal to a width of two dice and two dice can be shot at the same time. As shown in FIG. 10, two openings 42*b* are provided at positions at which the dice are placed and a photo sensor C is provided for each of the openings 42*b*. The photo sensor C is of the same type as the photosensor A, and is mounted so that an end of a rotating lever projects through the opening 42*b* when the shooting plate 42 is at a home position (shown in FIG. 9 by the solid line). Therefore, when a die is moved to the predetermined position of the shooting plate, the rotating lever is pressed by the die, and thus is rotated. Thus, whether or not each of the dice is positioned at the shooting position can be determined.

An extending portion 42*c* is provided at an extending end of the angular-C-shaped portion 42*a*. When rotation of the shooting plate 42 has been finished, the extending portion 42*c* is in a state in which the extending portion 42*c* enters a slit of a photosensor B of a photo interrupter mounted on the side plate 48A. Thereby, it can be determined that the shooting plate 42 has completed a shooting operation, that is, is at an end position.

In the above-described power transmission mechanisms, pulleys have teeth thereon and timing belts having waves thereon. Therefore, there is no possible problem due to a back rush occurring when using gears, and highly responsive power transmission mechanisms can be provided.

In the dice game machine 10, the two photosensors C are provided because the two dice are used. However, the number of the photosensors C may be appropriately altered according to alteration of the number of the dice. Further, instead of using the photosensors, electric micro limit switches or the like may be used.

The above-described shooting mechanism 114 is contained in the space 32 shown in FIG. 7. After being contained, when the above-described shooting plate 42 is at the home position, the shooting plate 42 is coincident with an opening 30a of the inclined portion 30. Accordingly, the dice, after sliding on the field 24 and the inclined portion 30, can be moved to positions on the shooting plate 42.

Figure 13:
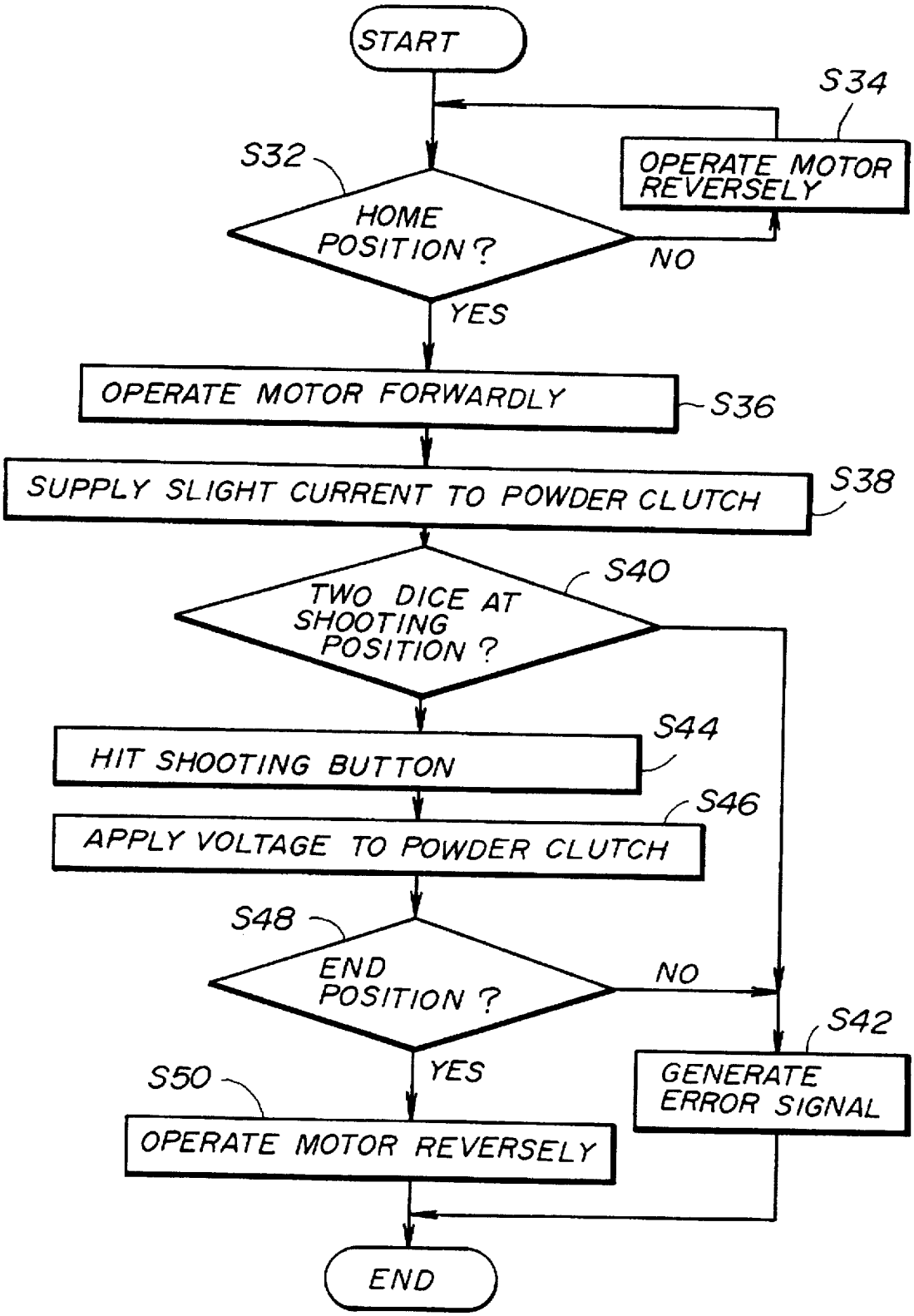
FIG. 13 shows a flowchart of an operation of the shooting mechanism of the dice game machine shown in FIGS. 2A, 2B and 2C.

An operation of the shooting mechanism 114 will now be described with reference to the flowchart shown in FIG. 13. The two dice are on the field 24 and are moved to the predetermined position (shown by a solid line in FIG. 8) on the shooting plate 42 by the collecting mechanism which will be described later. During the movement, each player of the dice game machine 10 guesses rolled numbers of the dice, sets and thus inputs to the dice game machine 10 points for the guessed rolled numbers. Further, the main CPUs 110 and 130 of the main control unit 100 provided in the body 12 specify a satellite as a subsequent shooter.

Then, it is determined in S32 whether or not the shooting plate 42 is at the home position. If the shooting plate 42 is not at the home position, the AC motor 44 is rotated along a direction reverse of that when shooting, and thus the shooting plate 42 is returned to the home position in S34. Then, in S32, when it is determined that the shooting plate 42 is at the home position, the AC motor 44 is rotated along a shooting direction and runs at a predetermined speed in S36. At this time, a predetermined slight electric current is supplied to the electromagnetic powder clutch 46 in S38. With this electric current, the electromagnetic powder clutch 46 is not in a torque transmission state. Therefore, in this state, the pulley C2 at the power input side of the electromagnetic powder clutch 46 is rotated via the timing belt C, while the pulley C1 at the power output side is not rotated.

When a predetermined time has elapsed and the AC motor 44 becomes to run at a constant rotational speed, it is determined in S40 whether or not the two dice are placed on the shooting position. If it is determined that at least one of the dice is not at the shooting position, an error signal is output in S42 and thus a shooting operation is stopped.

If it is determined that the two dice are at the shooting position, it is reported to the shooter (selected player) that preparation for shooting has been completed. Then the shooter hits the shooting button 26 in S44.

Figure 12:
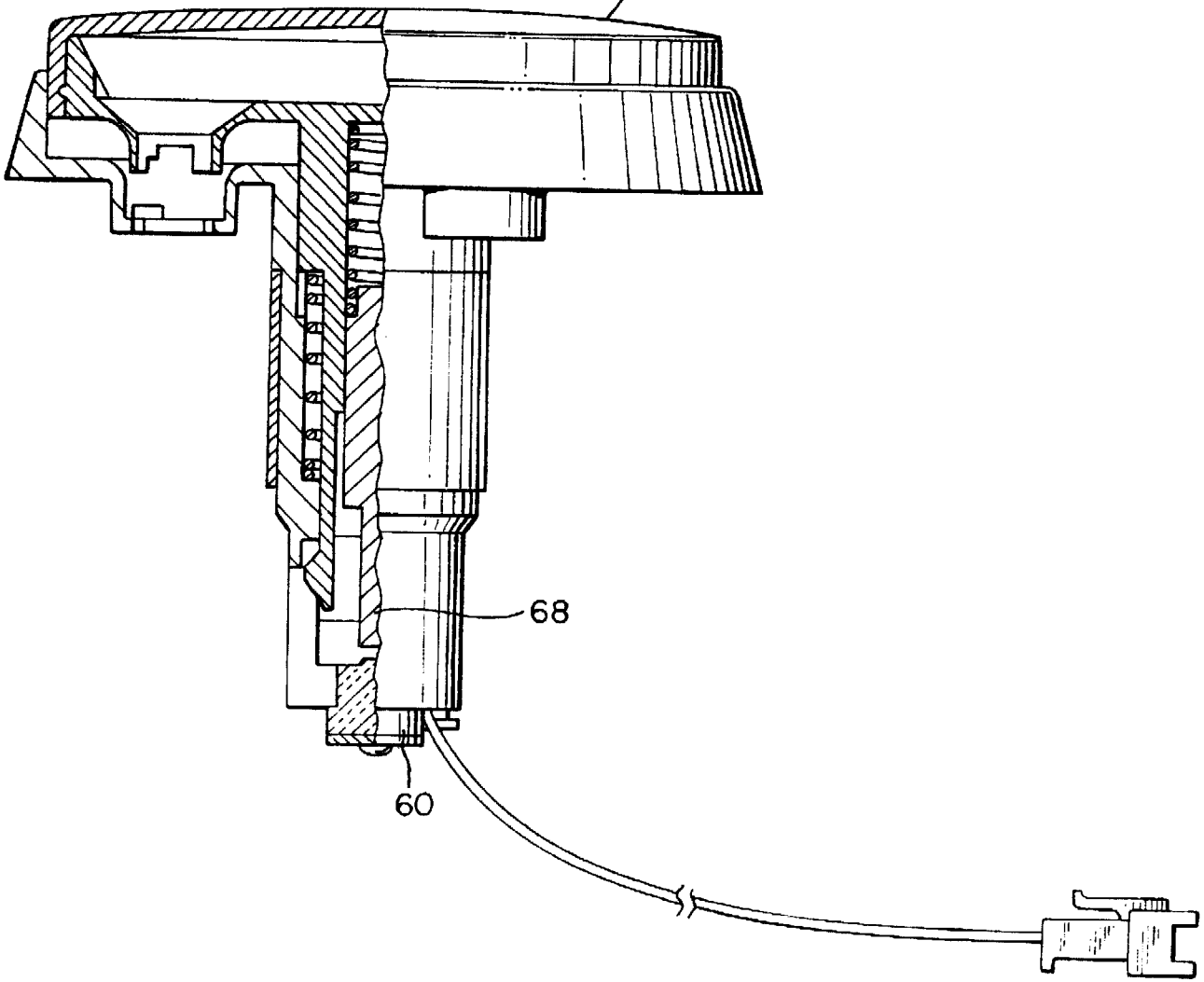
FIG. 12 show a side elevational and sectional view of a shooting button and accompanying components provided to each satellite of the dice game machine shown in FIGS. 2A, 2B and 2C.

As shown in FIG. 12, the shooting button 26 is linked to the voltage signal generating device 60 including the piezoelectric device or the like, and a voltage signal in proportion to the shooter's hitting intensity is output therefrom. A rubber cushion (not shown in the figure) is provided for the shooting button 26 such that shooter's hitting shock may not be directly transmitted to a panel on which the shooting button 26 is mounted. A pressing portion 68 is provided at the bottom of the shooting button 26, and when shock is applied to the shooting button, the shock is transmitted to the voltage signal generating unit 60 via the pressing portion 68 which then outputs the voltage signal according to the shock. This voltage signal is processed by the CPUs 310 and 320 of the satellite control unit 300, and converted into a digital signal which may have 128 grade levels. Based on a level of the digital signal, a voltage is applied to the electromagnetic powder clutch 46 in S46. Such a process for converting the voltage signal into the digital signal and applying of the relevant voltage may be performed using well-known circuits. Therefore, a description thereof will be omitted.

As described above, the shooting button 26 has a lamp inside thereof, and by lighting the lamp, a satellite of a shooter is indicated. In other words, a lit one of the shooting button 26 is one which can be used for shooting the dice.

As a result of an electric current in proportion of the hitting power being supplied to the electromagnetic powder clutch 46, the electromagnetic powder clutch 46 transmits a torque according to the electric current. That is, when the hitting power is weak, a sufficient exiting current is not supplied to the electromagnetic powder clutch 46. Therefore, the clutch 46 transmits a torque to the pulley C1 while sliding. By the torque transmitted to the pulley C1, the shaft 52 is rotated via the timing belts A and B, and the shooting plate 42 fixed on an end of the shaft 52 is rotated accordingly. As a result, the dice are shot toward the field 24. Accordingly, a shooting power of the dice is controlled by an electric current supplied to the electromagnetic powder clutch 46.

Then, the shooting plate 42 is rotated and it is determined in S48 whether or not the shooting plate 42 has reached the end position. If a predetermined time has elapsed without the shooting plate 42 having reached the end position since the rotation of the shooting plate 42 was started, S42 is executed. Then, an error signal is output. When it is determined that the shooting plate 42 has reached the end position, the AC motor 44 is rotated along the reverse direction and thus the shooting plate 42 is returned to the home position in S50, and thus the shooting operation is finished.

In the above-described shooting operation, by starting the rotation of the AC motor 44 prior to the shooter's hitting of the shooting button 26 in S36, it is possible to eliminate a time required for starting up the AC motor 44, and thus reduce a time required from the shooter's hitting of the shooting button 26 to the actual dice shooting operation. Further, by previously flowing a slight electric current through the electromagnetic powder clutch 46 in S38, it is possible to further reduce a time for responding to the shooter's hitting of the shooting button 26. Further, as described above, by changing an electric current to be supplied to the electromagnetic powder clutch 46, a sliding amount in the clutch 46 can be changed, and thus the dice shooting power can be arbitrarily controlled to be stronger or weaker.

By using such a construction of the shooting mechanism 114, a time required from the shooter's hitting to the start of an actual dice shooting operation can be greatly reduced. Further, the shooting power can be controlled as a result of controlling button hitting power. Accordingly, the shooter can feel in control as if the shooter actually threw the dice with his or her hand.

A shooting method applied in the present invention is not limited to the above-described method using the shooting button 26 and shooting mechanism 114. Any other method using determining means for numerically determining a manner in which a human being performs an operation such as a hitting operation, and driving means for giving an acceleration to a die according to a thus-determined numeral value can be applied.

For example, as the determining means, instead of the above-described formation using the piezoelectric device, two passing determining units can be used. Each of the passing determining units includes a light-emitting device and a photosensor disposed with a predetermined space. Ordinarily, light beams emitted by the light-emitting device reach the photosensor, and when something passes therebetween the light beams are blocked and thus passing is determined. The shooter passes his or her hand through the two sets of passing determining units successively. By measuring a time between the hand passing one of the two passing determining unit and the hand passing the other, a speed of the hand passing the two passing determining units can be determined. The driving means uses the thus-determined speed for determining an acceleration which is given to the die.

As the above-mentioned driving means, instead of the mechanism using the electromagnetic powder clutch and shooting plate, another mechanism can be used. For example, a compressor generates compressed air which is then used for blowing a die. Thus, an acceleration is given to the die. By providing a pressure control valve in a pipe for leading the compressed air to the die and appropriately operating the pressure control valve, it is possible to control the acceleration to be given to the die according to the numeric value of the manner in which the shooter performs an operation such as a hitting operation.

With reference to FIG. 7, the collecting mechanism 113 will now be simply described. The dice on the field 24 are pushed by a collect bracket 34*a* as a result of the collect bracket 34*a* moving along an X direction in the figure. As a result, the dice slide along the X direction and thus are carried to the inclined portion 30. A stopper 30*b* is provided at an X-direction end of the inclined portion 30, and projects obliquely vertically from the inclined portion 30 as a result of bending by a right angle. The two dice carried to the inclined portion 30 slide on the inclined portion 30 due to the inclination thereof. Then, the dice stop after come into contact with the stopper 30*b*.

A collect lever 34*b* is provided on the collect bracket 34*a* and, thereby, even if the two dice have been vertically stacked, the top die is dropped to the field 24 and thus the stacked state is canceled.

The collect bracket 34*a* is driven along the X direction as mentioned above by timing belts 33*d* and 33*e* fixed at two ends of the bracket 34*a*. These timing belts are driven via a pulley as a result of another timing belt 33*b* provided along directions Y1, Y2 in the figure being driven by a collect motor 33*a*. In order to ensure the function of this power transmission mechanism using the pulley, a pulley 33*c* is provided for applying an appropriate tension to the timing belt 33*c*.

For the two dice carried to the inclined portion 30 as mentioned above, a fillip bar 36*c* moves along the Y1 direction. Thereby, even if each of the two dice is in contact with the stopper 30*b* and the two dice are stacked on the stopper 30*b*, the top die is filliped and thus each of the two dice comes into contact with the stopper 30*b*. Then, as a result of a rotation of each of motors 35*a* and 36*a*, a respective one of timing belts 35*b* and 36*b* is driven along a respective one of the Y1 and Y2 directions. Thereby, attract pads 35*c* and 35*d* provided at projecting ends of two attract bars respectively move along the Y1 and Y2 directions respectively. As a result, the two dice are carried to the position of the opening 30*a*. As mentioned above, actually, the shooting plate 42 is provided at this position. Thus, the two dice are carried to the shooting plate 42.

As described above, in the collecting mechanism 113, by the functions of the collect bar 34*b* and fillip bar 36*c*, a stack state of two dice may be canceled. Therefore, the two dice are collected to the shooting plate 42 in a state in which the two dice are arranged along the Y1 and Y2 directions. As a result, it is possible to make a state of the dice identical for every shooting operation except for rolled numbers thereof. As a result, fairness of the game can be provided.

Further, it is preferable that an area of the field 24 is sufficiently wide. Thus, it should not be possible at all, at least prior to a shooting operation, for each player to precisely predict a detail of a movement of the dice in which the shot dice fly above the field 24, bounce off the above-mentioned wall, roll on the field 24, and then stop. Thus, the detail of the movement can be determined by each player immediately before the dice stop after the above-mentioned movement thereof. As a result, each player guesses rolled numbers of the dice by viewing positions (directions) of the dice each stage of the movement (being shot and then flying, bouncing off the wall, rolling on the field 24), and is glad and sad by turns. Thus, it is possible to increase interest in the game.

Similarly, it is preferable that the above-mentioned shooting mechanism has a capability for enabling the above-mentioned movement of the dice. Further, it is also preferable that the dome 22 provided above the field 24 provides a sufficiently wide space therein such that the dice can fly at a certain height. Further, it is preferable that each of the dice has a sufficiently large size such that each player standing in front of a relevant one of the satellites 18 can clearly determine a die number of each of the dice visually with his or her eyes.

The above-mentioned rolled number determining system according to the present invention will now be described.

A basic principle of the rolled number determining system will now be described with reference to FIG. 14. With reference to this figure, a change-over switch is operated so as to select a top terminal so that an AC electric current from an AC power source flows through an antenna formed of one electric wire. Then, if a tank circuit formed of a coil and a capacitor having a resonance frequency identical to a frequency of the AC power source is made to approach the antenna, this tank circuit starts a resonance phenomenon. If then the change-over switch is operated so as to select a bottom terminal and thus the flowing of the AC electric current through the antenna is stopped, the thus-started resonance phenomenon continues for a while due to a well-known characteristic of such a tank circuit. Such a phenomenon that a resonance oscillation continues without an external power supply is referred to as 'reverberation oscillation'. During this continuation of the reverberation oscillation, the tank circuit generates electromagnetic waves.

These electromagnetic waves are received by the above-mentioned antenna. The change-over switch is operated so as to select the bottom terminal and thus the antenna is connected to a detecting unit. The electromagnetic waves thus received by the antenna acting as an electric signal are supplied to the detecting unit. The detecting unit determines the presence of the tank circuit having the resonance frequency identical to the frequency of the above-mentioned AC power source, by determining that the electric signal is supplied to the detecting unit.

Figure 15:
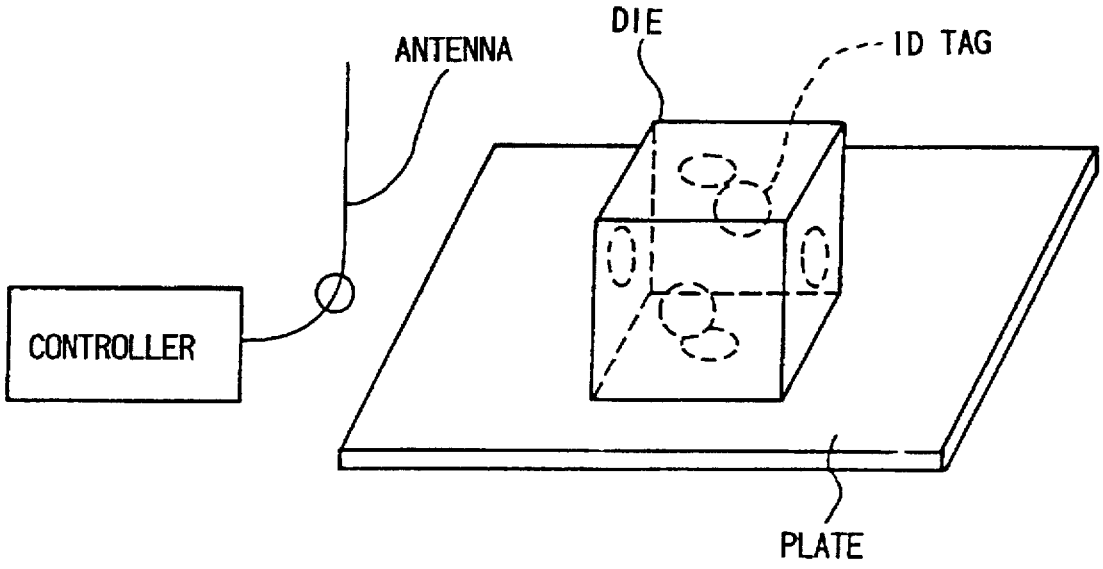
FIG. 15 shows a layout which can be considered for realizing a system shown in FIG. 14.

Possible problems which occur when such a technology is attempted to be applied to the above-mentioned rolled number determining system will now be described with reference to FIG. 15. FIG. 15 generally illustrates an example of a method for applying the above-described technology to the rolled number determining system. In the figure, a controller includes the above-mentioned AC power source, detecting unit and change-over switch. In this example, an antenna is provided beside a plate on which a die is placed and extends perpendicular to the plate. Six ID tags are embedded in the die and each thereof is located in proximity to the center of a relevant one of six sides of the die.

Each of the ID tags is formed of the above-mentioned tank circuit and the resonance frequency thereof is different from that of each of the others. In such a system, a plurality of tank circuits having resonance frequencies different from another acting as the ID tags are present around the antenna. In order to realize the above-mentioned rolled number determining system, it is necessary to identify a tank circuit which is embedded in a side of the die facing a specific direction, for example, a tank circuit which is embedded in a side of the die facing upward or a side of the die facing downward.

Spatial relationships each between the antenna and a respective one of the tank circuits embedded in the die are different from one another when the die is placed on the plate as shown in FIG. 15. Electromagnetic waves emitted from the antenna cause a reverberation oscillation in each tank circuit, and electromagnetic waves resulting from the thus-caused reverberation oscillations are received by the antenna. It is considered that signal levels of the electromagnetic waves thus received by the antenna may be different from one another due to the above-mentioned difference of the spatial relationships. This difference of the received electromagnetic waves can be determined based on the frequency components thereof.

The AC power source sends out through the antenna one electromagnetic wave at a time having a frequency equal to the resonance frequency of each tank circuit. At each time, signal levels of electromagnetic waves which are generated by the tank circuits due to resulting reverberation oscillations and then received by the antenna are measured for the frequency components corresponding to the resonance frequencies of the six tank circuits respectively. By comparing the thus-measured signal levels, a tank circuit having a specific spatial relationship with the antenna may be identified.

Possible problems which may occur in such a method will now be described. In order to perform the above identification precisely, it is necessary to reduce spurious radiation in transmitting electromagnetic wave, and also increase the 'Q' of each tank circuit. In order to reduce the spurious radiation in transmitting electromagnetic wave, it is necessary to make a length of the antenna the same as a wavelength of a relevant frequency. However, if an antenna having such a length is used, the antenna itself starts a resonance phenomenon, and it is difficult to appropriately identify electromagnetic waves sent out from the tank circuits. In order to prevent occurrence of such a state, it is necessary to make the length of the antenna different from the wavelength of the relevant frequency. However, if the length of the antenna is different from the wavelength of the relevant frequency, an electromagnetic wave emitted from the antenna includes significant spurious radiation.

Further, if the 'Q' of each tank circuit is increased, it is difficult to provide a tank circuit with a miniaturized size and a light weight. As a result, approximately Q=80 is a maximum value. Further, if each tank circuit is embedded in proximity to a surface of a relevant side of the die, it is necessary to make weights of all of the tank circuits substantially the same as each other so as to make the center of mass of the die coincident with the center of the die.

Further, the AC power source supplying AC power to the antenna generates an electromagnetic wave having a frequency equal to a resonance frequency of each tank circuit. In this case, it is economical for providing the AC power source that each difference between the frequencies to be generated is as small as possible. Thus, it is not preferable that a difference between the resonance frequencies of the tank circuits is enlarged.

If a difference between the resonance frequencies of the tank circuits is small, when an electromagnetic wave having a specific frequency is emitted from the antenna, a plurality of tank circuits having resonance frequencies near the frequency of the emitted electromagnetic wave simultaneously start a resonance phenomena. Then, electromagnetic waves having a plurality of frequencies resulting from resulting reverberation oscillations of these tank circuits are simultaneously received by the antenna. In this case, signal levels of frequency components of the thus-received electromagnetic waves which are sent out from the plurality of tank circuits are approximately equal to each other. Therefore, it may be difficult to identify a specific frequency component from the approximately equal levels of the frequency components.

Thus, it is difficult to accurately identify a tank circuit which is embedded in a side of the die facing a specific direction.

Figure 14:
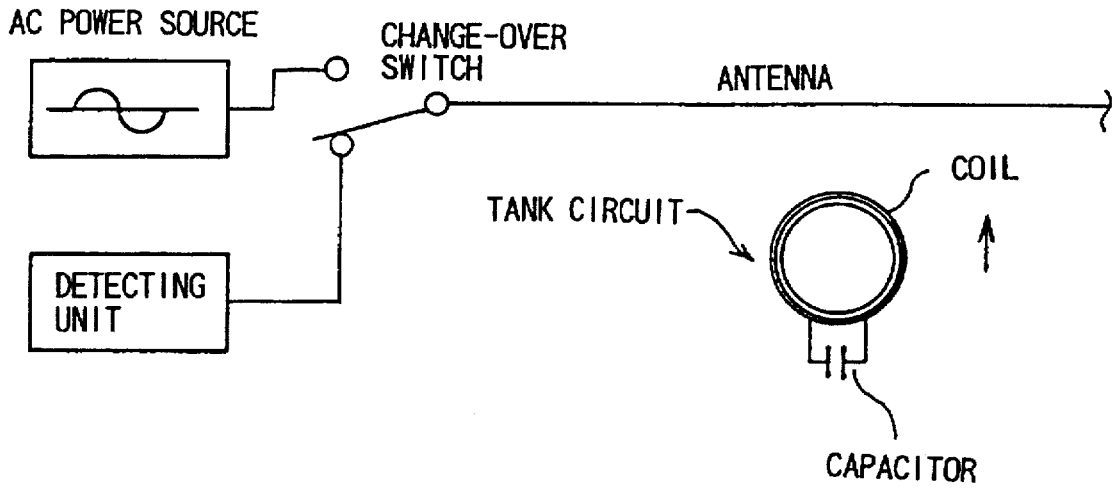
FIG. 14 illustrates a principle of an apparatus for determining a part of an object.
Figure 16:
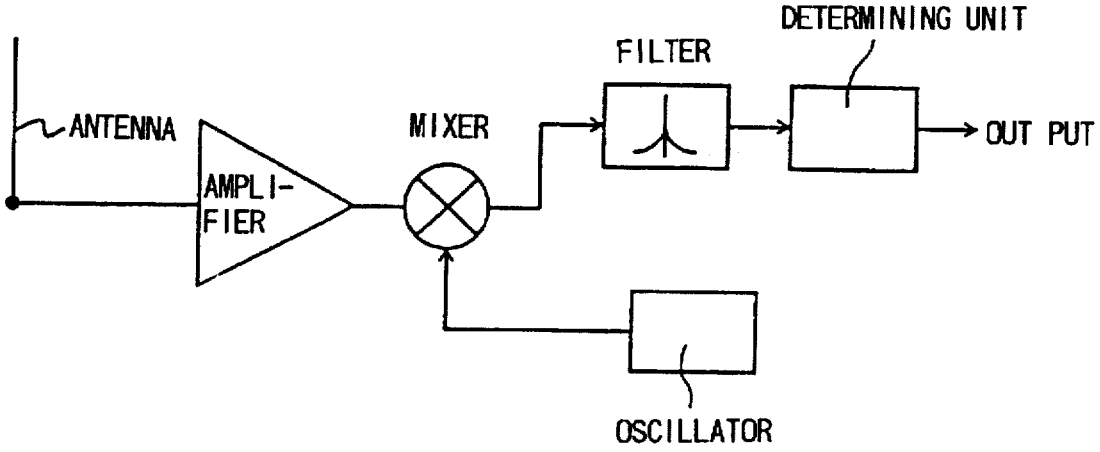
FIG. 16 shows a block diagram of a system which can be considered to be a detecting unit in the system shown in FIG. 14.

FIG. 16 shows a block diagram of an example of the detecting unit shown in FIG. 14. This detecting unit uses a well-known superheterodyne system and thus measures a signal level of an electromagnetic wave received through the antenna for each frequency component. However, as mentioned above, it is difficult to increase the 'Q' of each tank circuit. Further, in order to provide a tank circuit having a light weight, it is difficult to provide a tank circuit in which a continuation time of a reverberation oscillation is sufficiently long. Therefore, it is difficult to improve an S/N ratio when a signal level of a specific frequency component is measured, and thus it is difficult to measure a signal level of a specific frequency component with high accuracy.

Figure 17:
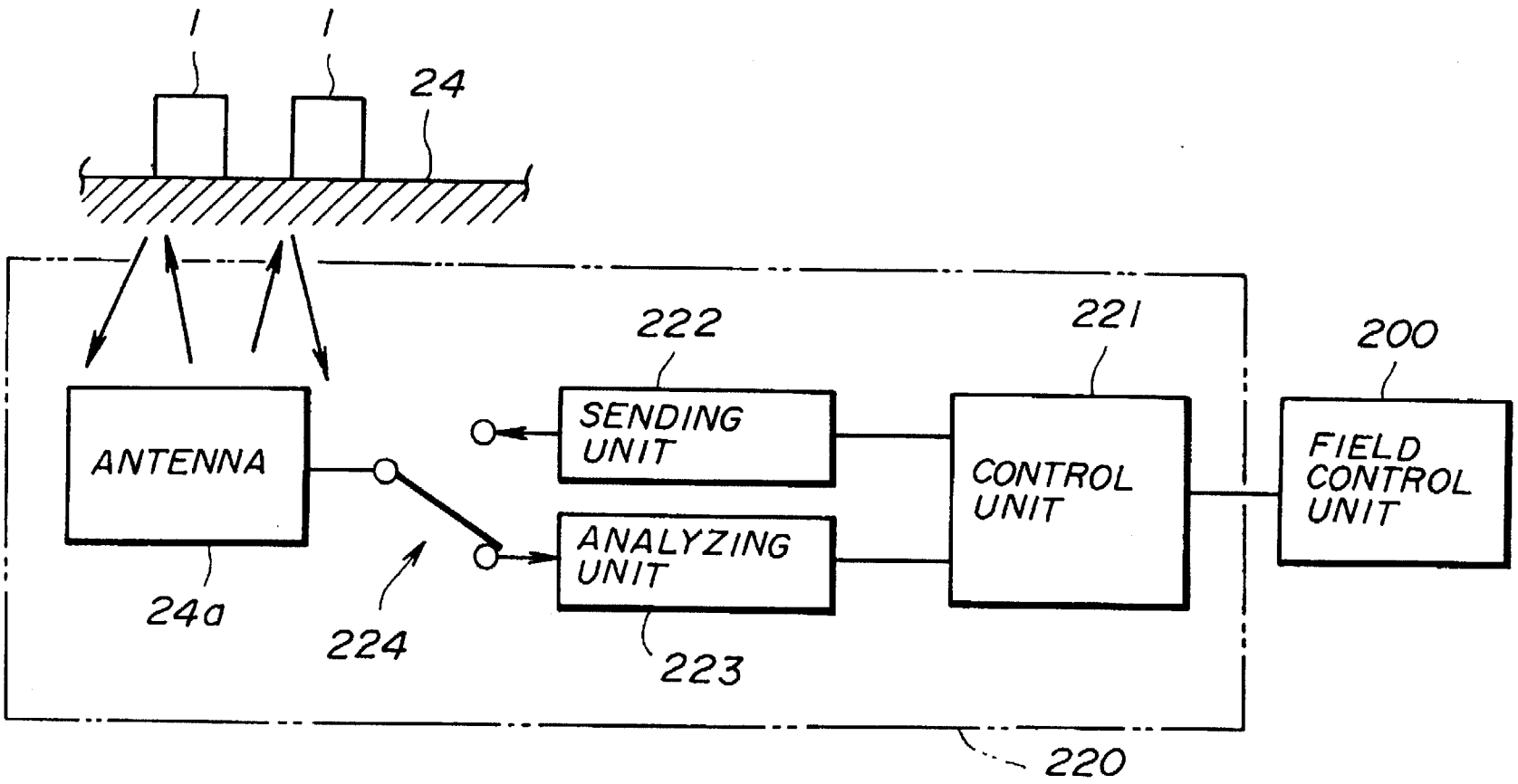
FIG. 17 shows a block diagram of a detecting unit 220 shown in FIG. 2.

The rolled number determining system used in the above-mentioned dice game machine 10 and which applies an apparatus for determining a part of an object according to the present invention can solve the above-mentioned problems. This rolled number determining system will now be descried. FIG. 17 generally shows a block diagram of the detecting unit 220 shown in FIG. 3A, which uses this rolled number determining system.

As mentioned above, the detecting unit 220 includes the control unit 221, sending unit 222, analyzing unit 223 and antenna **24*a*, and, in addition, includes a change-over switch 224. The sending unit 222 responds to an electromagnetic wave sending out an instruction signal, and, through the antenna 24*a*, sends out electromagnetic waves, one at a time, having frequencies corresponding to resonance frequencies of the above-mentioned twelve transponders of the two dice 1. The analyzing unit 223 receives, via the antenna 24*a*, electromagnetic waves sent out from the transponder 4 of the dice, and supplies information of frequencies of the electromagnetic waves. The control unit 221 uses the thus-supplied information of the frequencies and then determines rolled numbers of the dice. The change-over switch 223 acts as the change-over switch shown in FIG. 14, and changes connection of the antenna 24*a*. Thus, the antenna 24*a*** can be appropriately used as a transmitting antenna and also as a receiving antenna.

Information of twelve resonance frequencies of the transponders 4 of the dice 1 are previously stored in the control unit 221. The control unit 221 uses the information and causes the analyzing unit 223 to compare each of the twelve frequencies with a frequency of a received electromagnetic wave. As a result, two frequencies are obtained. Then, the control unit 221 obtains information of rolled numbers of dice 1 to which resonance frequencies corresponding to the thus-obtained two frequencies are previously assigned respectively. The thus-obtained rolled number information is sent to the field control unit 200.

Ordinarily, in the dice game machine 10, the dice 1 stop on the field 24 in a state in which a side of each of the dice 1 comes into contact with the field 24. As a result of the above-mentioned analysis, a resonance frequency of one of the transponders 4 of a first die of the two dice 1 and a resonance frequency of one of the transponders 4 of a second die of the two dice 1 should be obtained. Accordingly, the rolled number information sent to the field control unit 200 from the control unit 221 as a result is information of a rolled number of the first die and a rolled number of the second die.

If, for example a state shown in FIG. 28B which will be described later occurs, it may be that both of two frequency components obtained as a result of analyzing received electromagnetic waves indicate dice numbers of the bottom die. In order to prevent such a determination result, in such a case, the control unit 221 supplies an error signal to the field control unit 200, and in response to this, the CPU 210 of the field control unit 200 determines the game result to be an operation failure. This determination is then sent to the main control unit 100 which, as a result, causes the collecting mechanism 113 to collect the dice and send them to the shooting mechanism 114. Further, the main control unit 100, via the satellite control unit 300 of a satellite of a relevant shooter, urges the shooter to again hit the shooting button 26.

Figure 18:
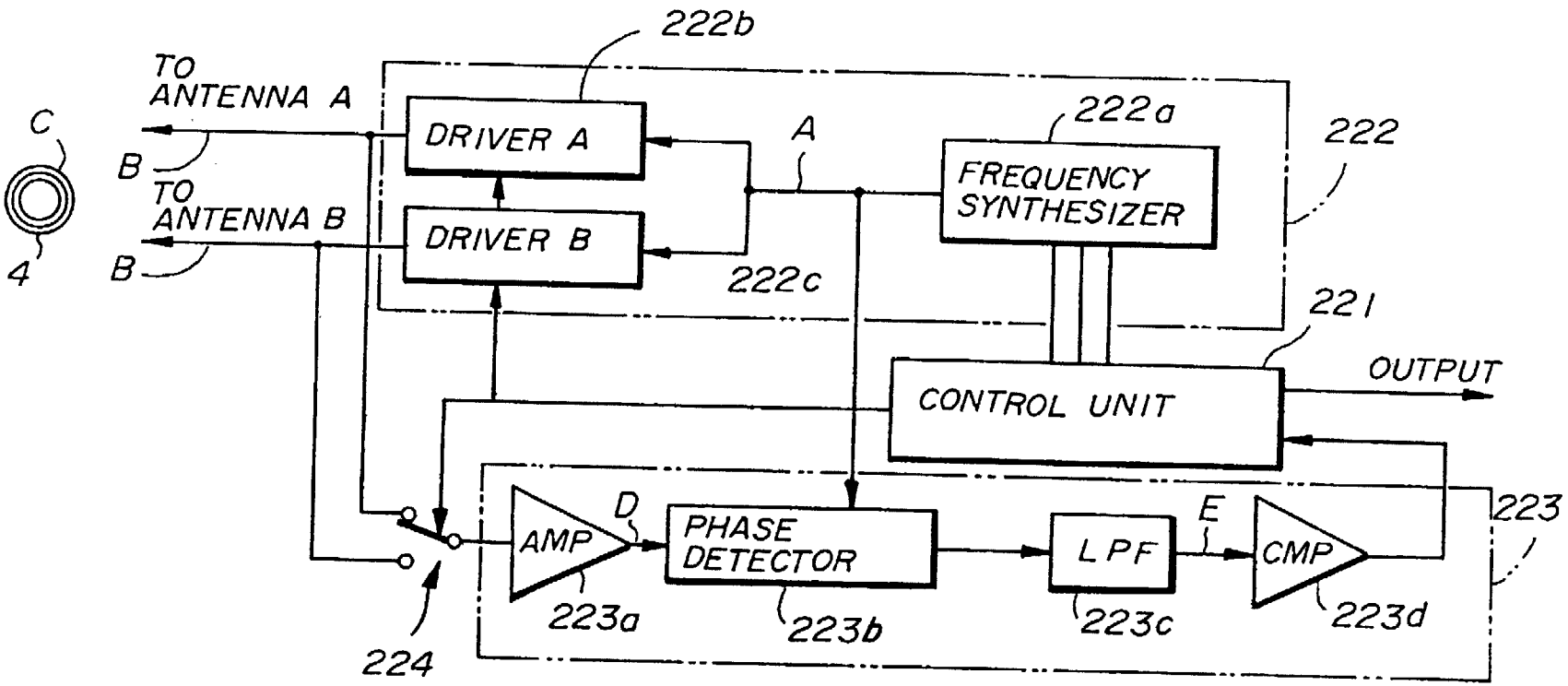
FIG. 18 shows a more detailed block diagram of the detecting unit shown in FIG. 17.

With reference to FIGS. 18, 19A, 19B, 19C, 19D, 19E, 19F, 20A, 20B, 20C, 20D, 20E and 20F, further details of the above-described detecting unit 220 will now be described. FIG. 18 shows further details of the detecting unit 220 shown in FIG. 17. FIGS. 19A, 19B, 19C, 19D, 19E, 19F, 20A, 20B, 20C, 20D, 20E and 20F show signal waveforms in a circuit shown in FIG. 18.

The detecting unit 220 having the formation shown in FIG. 18 extracts a frequency component having a phase coincident with a phase of an electromagnetic wave sent out from the antenna, which is a power source of reverberation oscillations, from among electromagnetic wave signals which are sent out from tank circuits as a result of the reverberation oscillations thereof and received through the antenna. The detecting unit 220 measures a signal level of the thus-extracted frequency component. Thus, a signal level at the antenna of the electromagnetic wave sent out from the tank circuit having the resonance frequency equal to the frequency of the electromagnetic wave signal sent out from the antenna is measured.

Specifically, the control unit 221 acting as a CPU controls a frequency synthesizer **222*a* which generates electromagnetic wave signals, one at a time, having a plurality of frequencies equal to the resonance frequencies of the twelve transponders 4 (tank circuits) of the two dice 1, as a result of selecting one of them sequentially. It is preferable that the frequency synthesizer 222 includes a well-known PLL circuit having a VCO (Voltage Controlled Oscillator). The thus-generated electromagnetic signals are supplied to a driver A 222*b* and a driver B 222*c*. Operations of the two drivers are controlled by the control unit 221**, and are made to be ON/OFF in a timing which will now be described. The two drivers are alternately activated and a time interval of a fixed time is present between times of activations of the two drivers.

Specifically, the driver A is activated, and then after a predetermined time has elapsed, the driver A is deactivated. Then, after a predetermined time has elapsed, the driver B is activated and then after a predetermined time has elapsed, the driver B is deactivated. Further after a predetermined time has elapsed, the driver A is activated. The above-described operation is one cycle of operation. The cycle of operation is repeated each time a frequency generated by the frequency synthesizer **222*a*** is changed.

The drivers which thus have an electromagnetic signal supplied thereto then send out a corresponding electromagnetic wave through an antenna A and an antenna B. As shown in FIG. 24B, elements of the antennas A and B are alternately disposed in a rectangular detection area, and thus dead zones which may have otherwise appeared between antenna elements are canceled.

Figures 19A, 19B, 19C, 19D, 19E, 19F:
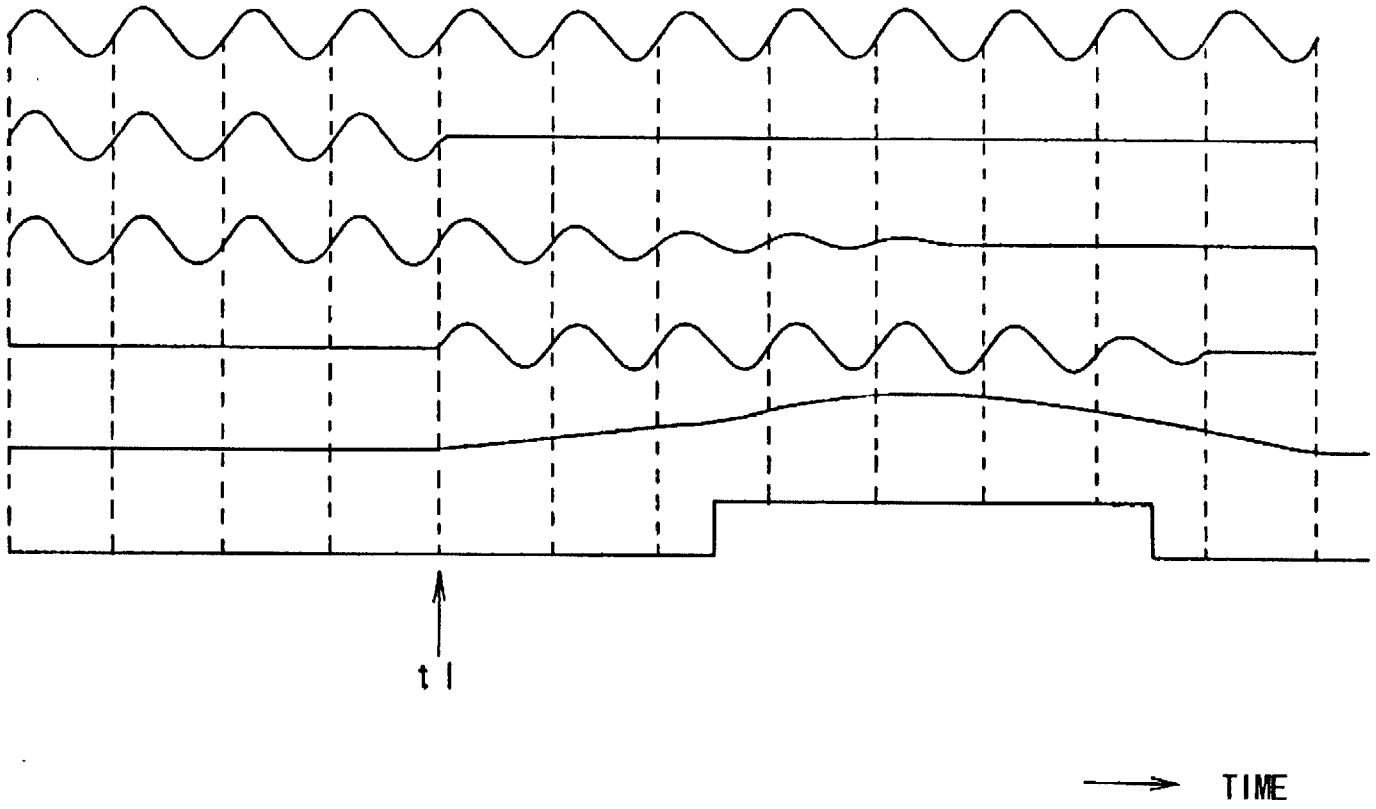
FIGS. 19A, 19B, 19C, 19D, 19E, 19F, 20A, 20B, 20C, 20D, 20E and 20F show waveforms in signals in a circuit shown in FIG. 18.
Figures 20A, 20B, 20C, 20D, 20E, 20F:
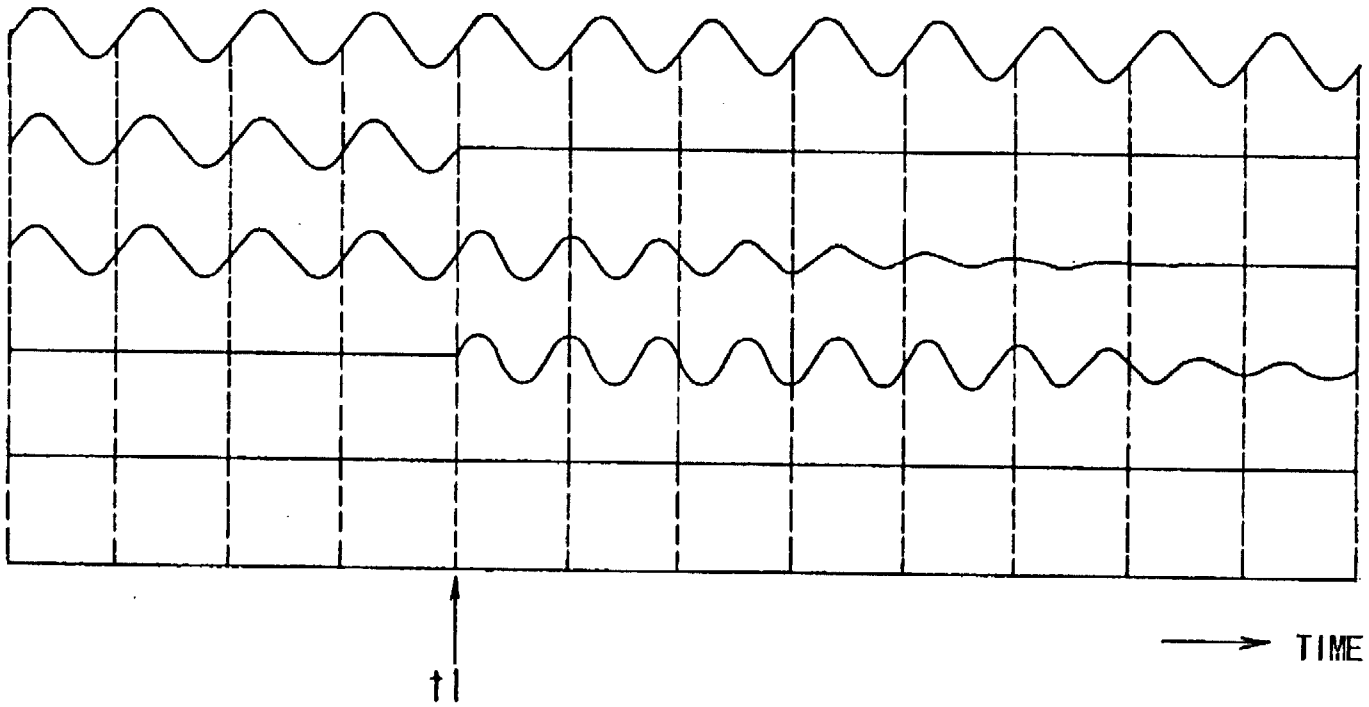

A waveform of one of the electromagnetic wave signals which are generated one at a time by the frequency synthesizer **222*a*, that is, a waveform of a signal at a point A in a circuit shown in FIG. 18 is shown in FIGS. 19A and 20A. Further, a waveform of an electromagnetic signal supplied to the antenna A or antenna B, that is, a waveform of a signal at a point B in the circuit shown in FIG. 18 is shown in FIGS. 19B and 20B. Because operation timings of the drivers A and B are controlled by the control unit 221 as mentioned above, the supply of the electromagnetic wave signal to the antenna A or antenna B is stopped at a time t1 as shown in FIGS. 19B and 20B. After the time t1**, a signal level at the point B is zero.

Specific resonance frequencies of the twelve tank circuits of transponders 4 are twelve frequencies respectively which are obtained as a result of equally dividing a frequency range between approximately 250 kHz and 593 kHz into eleven divisions, each having an approximately 31-kHz range. The frequency synthesizer **222*a*** generates the twelve frequencies one at a time.

The electromagnetic waves thus sent out from the antennas are received by the tank circuits of the transponders 4 of the dice 1. The tank circuits then start resonance at their own resonance frequencies respectively. FIG. 19C shows a waveform of a resonance signal in a tank circuit having a resonance frequency equal to the frequency of an electromagnetic wave currently generated by the frequency synthesizer **222*a*, that is, the frequency of the waveform shown in FIGS. 19A, 19B, 20A and 20B. This tank circuit is one of the above-mentioned twelve tank circuits. The waveform shown in FIG. 19C is a waveform of a signal at a point C in the circuit shown in FIG. 18. FIG. 20C shows a waveform of a resonance signal in a tank circuit having a resonance frequency different from the frequency of the electromagnetic wave currently generated by the frequency synthesizer 222*a***.

The currently generated frequency is that shown in FIGS. 19A, 19B, 20A and 20B. However, the antennas inevitably emit spurious radiation of the relevant frequency as described above. Due to the spurious radiation, tank circuits having resonance frequencies other than the frequency currently generated by the frequency synthesizer **222*a*** perform resonance.

These tank circuits send out electromagnetic waves having relevant resonance frequencies due to the resonances and reverberation oscillations after the time t1 shown in FIGS. 19A–19F, 20A–20F at which transmission of electromagnetic waves from the antenna have been stopped. The electromagnetic waves thus transmitted from the tank circuits are received by the antennas A and B.

A change-over switch 224 operates in synchronization with the alternating activating/deactivating operation of the two drivers A and B, under control of the control unit 221.

Specifically when one of the drivers A and B is activated, the change-over switch 224 is controlled so that an amplifier 223*a* is connected to none of the antennas A and B. After the driver A is deactivated and thus while each of the drivers A and B is not in the activated state, the antenna A is connected to the amplifier 223*a*. After the driver B is deactivated and thus while each of the drivers A and B is not in the activated state, the antenna B is connected to the amplifier 223*a*. As a result, immediately after an electromagnetic wave has been sent out from the antenna A, an electromagnetic wave received by the same antenna A is supplied to the amplifier 223*a*. Similarly, immediately after an electromagnetic wave has been sent out from the antenna B, an electromagnetic wave received by the same antenna B is supplied to the amplifier 223*a*.

As a result, the electromagnetic wave signal of the electromagnetic wave received by a relevant antenna after the time t1 is supplied to the amplifier 223*a* in the analyzing unit 223. The amplifier 223*a* amplifies the electromagnetic signal. Waveforms of thus-amplified electromagnetic signals are shown in FIGS. 19D and 20D.

Due to a function of the amplifier 223*a*, during gradual attenuation of the reverberation oscillations in relevant tank circuits shown in FIGS. 19C and 20C, magnitudes of the oscillations are further maintained above a predetermined value as shown in FIGS. 19D and 20D in output of the amplifier 223.

A phase detector 223*b* compares a phase of the signal generated by the frequency synthesizer 222*a* and a phase of the signal supplied by the amplifier 223*a*. When the two phases are coincident with each other, specifically, polarities (positive or negative) of the two signal are coincident with each other, a positive-magnitude signal having a magnitude according to the magnitudes of the two signals is output by the phase detector 223*b*. As a result, if the frequencies and phases are coincident with each other between the two signals, that is, in the case of FIGS. 19A and 19D, the phase detector 223*b* outputs a signal having a positive magnitude according to the magnitude of the waveform shown in FIG. 19D and a frequency of twice that of the waveform shown in FIG. 19D.

The thus-output signal passes through a low-pass filter 223*c* and thus a signal having a waveform shown in FIG. 19E is obtained at a point E in the circuit shown in FIG. 18. This filter 223*c* is formed of a well-known RC filter of a simple formation, and outputs a signal shown in FIG. 19E such that a signal level increases while the magnitude of the signal shown in FIG. 19D is maintained at a fixed level and decreases according to attenuation thereof.

The thus-output signal is compared with a predetermined level by a comparator 223*d*, and thus becomes a pulse signal having a high level while the original signal level is higher than the predetermined level. A waveform of the resulting pulse signal is shown in FIG. 19F.

In this case, the comparator 223*d* is used for the sake of simplification of the description. However, actually, instead of the comparator 223*d*, an analog-to-digital converter is used. Using the analog-to-digital converter, the magnitude of the signal at the point E in the circuit shown in FIG. 18 is converted into a digital value, and a digital signal having the digital value is used by the control unit 221 to determine a signal level of a signal having a relevant resonance frequency.

The electromagnetic wave signal, shown in FIG. 20C, sent out from the tank circuit which has the resonance frequency different from the frequency of the signal generated by the synthesizer 222*a* is also amplified by the amplifier 223*a*. As a result, attenuation is suppressed as shown in FIG. 20D. A phase of this signal is then compared with the phase of the signal generated by the synthesizer 222*a* by the phase detector 223*b* shown in FIG. 20A. Frequencies of the two signals are different from each other and thus the phases thereof are different from each other. As a result, the phase detector 223*b* outputs a signal of a level oscillation between a positive level and a negative level. This signal is then passed through the low-pass filter 223*c*. Due to the above-mentioned level oscillation between a positive level and a negative level, the resulting signal has a level of substantially zero as shown in FIG. 20E. This zero level is lower than the predetermined level in the comparator 223*d* and thus a signal having a fixed low level is supplied from the comparator 223*d*. The above-mentioned analog-to-digital converter used instead of the comparator 223*d* also outputs a digital signal indicating the zero level.

Thus, each time a frequency generated by the synthesizer 222*a* is changed, the electromagnetic waves sent out from the tank circuits of all of the twelve transponders are simultaneously analyzed by the analyzing unit 223. Accordingly, actually, an electromagnetic wave signal having the twelve frequency components are simultaneously supplied to the amplifier 223*a*, and then are simultaneously processed by the phase detector 223*b*, low-pass filter 223*c*, and comparator 223*d*.

As a result, a signal output from the phase detector 223*b* is a total of signals having twelve frequencies. As a magnitude of the output signal is larger, a signal level of a signal having passed through the low-pass filter 223*c* is maintained above the predetermined level for a longer time. As a result, a time for which a signal output from the comparator 223*d* is at the high level is longer.

It is considered that a function of consequently raising the signal level of the signal output from the phase detector 223*b* performed by the electromagnetic wave sent out from the tank circuit having the resonance frequency the same as the frequency of the electromagnetic wave generated by the synthesizer 222*a* is extremely high. In contrast to this, a similar function performed by another tank circuit is low.

Accordingly, it can be said that, a result of the analysis for the frequency of the electromagnetic wave currently generated by the synthesizer 222*a* substantially depends on only a signal level of the electromagnetic wave received by the antenna 24*a* which is sent out from the tank circuit having the resonance frequency the same as the frequency of the currently generated electromagnetic wave. In other words, it can be said that a time for which the signal output by the comparator 223*d* is at the high level substantially depends on only the signal level sent out from the relevant tank circuit and received by the antenna. As mentioned above, actually, the analog-to-digital converter is used instead of the comparator 223*d*. In this case, it can be said that a value indicated by the digital signal obtained by the analog-to-digital converter 223*d* substantially depends on only the signal level sent out from the relevant tank circuit and received by the antenna.

As mentioned above, the synthesizer 222*a* generates one at a time the twelve frequencies the same as twelve resonance frequencies of the tank circuits. The electromagnetic waves sent out from the tank circuits in response to the twelve generated frequencies are analyzed by the analyzing unit 223 as described above. As a result, when an output signal from the comparator 223*d* is at the high level for the longest time, a tank circuit having the resonance frequency the same as the frequency generated by the synthesizer 222a at the time is determined as being a relevant tank circuit. Actually, when the analog-to-digital converter is used instead of the comparator, when a digital signal having the largest value is obtained therefrom, a tank circuit having the resonance frequency the same as the frequency generated by the synthesizer 222a at the time is determined as being a relevant tank circuit.

This relevant tank circuit is a tank circuit which, at the time, can most effectively receive the electromagnetic wave emitted by the antenna and also the antenna can most effectively receive the electromagnetic wave sent out from this tank circuit. This tank circuit should be a tank circuit which is embedded in a side of the die, which side, at the time, faces downward, that is, is in contact with the field 24. The antenna 24a should be formed so as to achieve this.

It is preferable that the antenna 24a is formed such that an electromagnetic wave transmission efficiency is especially high when the tank circuit embedded in the downward facing side of the die receives the electromagnetic wave sent out from the antenna and that the antenna receives the electromagnetic wave sent out from this tank circuit. Thereby, it is possible to improve an accuracy of identifying the relevant tank circuit as a result of the analysis by the analyzing unit 223.

Figure 21:
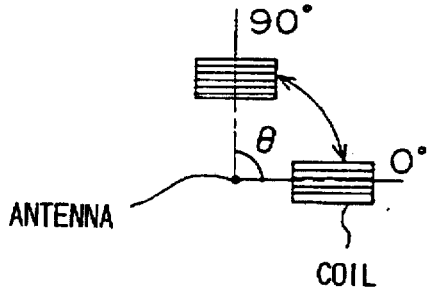
FIGS. 21, 22A and 22B illustrate a principle of an antenna of an apparatus for determining a part of an object according to the present invention.

A preferable formation of the antenna for providing the above-mentioned advantages will now be described with reference to FIGS. 21, 22A, 22B, 23A, 23B, 24A and 24B. FIG. 21 shows a spatial relationship between an antenna and an electric coil of a tank circuit. In the figure, the antenna is linear and extends along a direction perpendicular to the sheet on which this figure is drawn. An axis, about which each winding turn is wound, of the coil extends vertically in the figure.

A case will now be considered in which a fixed electric current is made to flow through the antenna, and the coil is rotated around the antenna in a condition in which a distance between the coil and antenna is fixed and the axis of the coil always extends vertically. In this case, when the coil is rotated a rotation angle $\Theta$ from a state of 0°, an electric current induced in the coil is obtained as a result of multiplying an electric current induced in the state of 0° by $\cos\Theta$. Specifically, if an electric current induced in the coil in the state of 0° is '1', an electric current induced in the coil in a state of 90° in the figure is '0'.

Figure 22A:
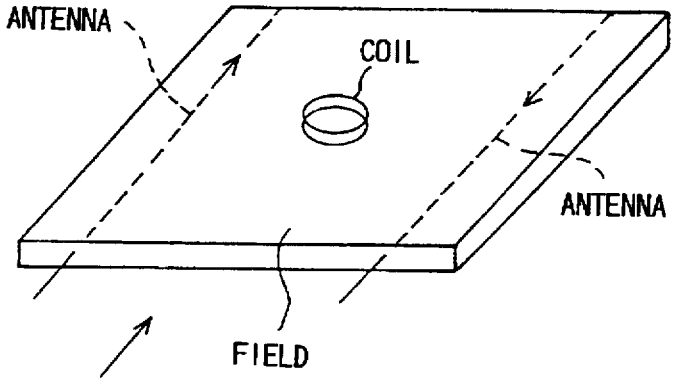
Figure 22B:
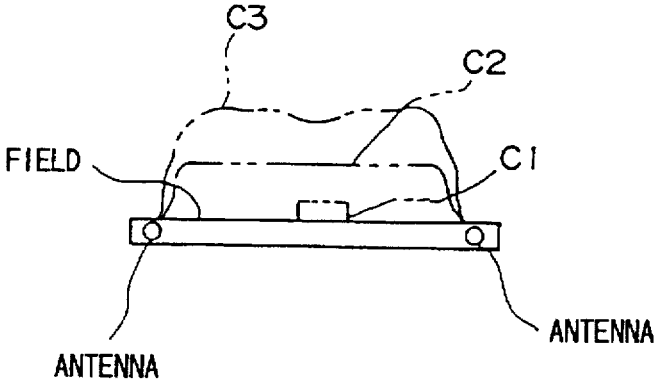

Using this principle, two antennas shown in FIG. 22A are considered. FIGS. 22A and 22B illustrate a principle of an apparatus for determining a part of an object according to the present invention. The two antennas are embedded in a field in parallel to each other, and AC electric currents having phases reverse of each other are made to flow through the two antennas. As a result, electric currents having directions reverse of each other are made to always flow through the two antennas.

Above this field, a coil is moved in a condition in which an axis, about which each winding turn is wound, of the coil is always perpendicular to the field. FIG. 22B shows a result of measuring an electric current induced in the coil during the above-described movement of the coil above the field. FIG. 22B shows a front view of a formation shown in FIG. 22A viewed along a direction B shown in FIG. 22A.

With reference to FIG. 22B, if an electric current induced in the coil in a condition C1 in which the coil is in contact with the field is '1', electric currents induced in the coil in a condition in which the coil is moved along lines indicated by C2 and C3 (vertically away from the field) are '0.8' and '0.4'. Thus, an induced electric current becomes larger as the coil is made to approach the field. Further, if the coil moves vertically far away from the field, in particular, further than the state shown in the line C3, an induced electric current becomes extremely small.

This is because, if the coil moves vertically far away from the field in which the antennas are provided, a direction $\Theta$ of the coil with respect to the antenna becomes larger. By providing a formation of the antennas such as that shown in FIG. 22A, an electric current induced in the coil present at a fixed height between the two antennas is substantially uniform over a considerably wide area.

In a tank circuit embedded in proximity to each side of the die, an axis, about which each winding turn is wound, of an electric coil of the tank circuit is perpendicular to the relevant side. In other words, a plane which includes each winding turn of the coil is in parallel to the relevant side. For example, in FIG. 15, it can be considered that each circle representing a respective ID tag corresponds to a shape of a winding turn of the relevant coil.

By using the above-described formation of antennas, when a side of the die in which a relevant tank circuit is embedded in proximity to each side is in contact with the field, it is possible to make an electric current induced in the relevant tank circuit be a uniform value. Further, it is possible to make an electric current induced in a tank circuit embedded in a side other than the side in contact with the field be extremely small in comparison to the above-mentioned uniform value.

There is a case where the axis of the coil extends in parallel to the field, in other words, a case where a plane which includes each winding turn of the coil is perpendicular to the field. In this case, there are two sub-case, a sub-case where the coil axis extends in parallel to each antenna, and another sub-case where the coil axis extends perpendicular to each antenna. An electric field generated by each antenna extends along a plane perpendicular to the antenna. Therefore, when the coil axis is in parallel to the antenna extending direction, an electric current induced in the coil is substantially zero. When the coil axis is perpendicular to the antenna extending direction, similarly to the case where the coil axis is perpendicular to the field, a significant electric current is induced in the coil.

When the die is present on the field, an axis of a coil embedded in a side of the die which is perpendicular to the field is in parallel to the field. If the coil axis is further perpendicular to the antenna extending direction, a significant electric current flows through the relevant coil. However, even in such a condition, as the coil is far away from the field, as described with reference to FIG. 22B, an electric current induced in the relevant coil is smaller. As shown in FIG. 15, a coil embedded in a side of the die which extends perpendicular to the field is considerably far away from the field. Therefore, an electric current induced in the relevant coil is relatively small. Therefore, it is possible to distinguish an electric current induced in such a coil from an electric current induced in a coil embedded in a side of the die which is in contact with the field.

Figure 23A:
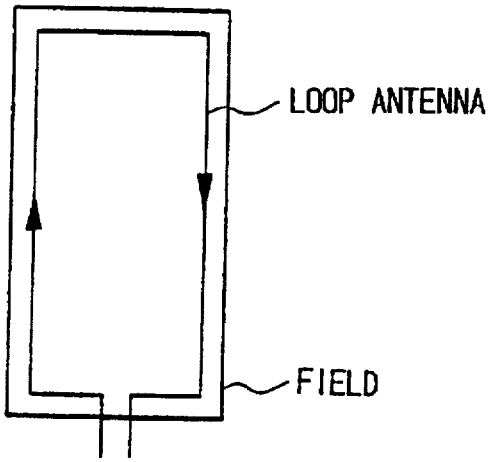
FIGS. 23A, 23B, 24A and 24B illustrate constructions of antennas each of which may used in an apparatus for determining a part of an object according to the present invention.

A formation of an antenna can be easily realized by forming a loop such as that shown in FIG. 23A. In the formation, a length for which the antenna linearly extends can be sufficiently short in comparison to a wavelength of a resonance frequency of each tank circuit. By making a length for which the antenna linearly extends sufficiently short in comparison to a wavelength of a resonance frequency of each tank circuit, the antenna itself can be prevented from resonating.

In order to provided a tank circuit with a miniaturized size and a light weight, it is difficult to make a resonance frequency of each tank circuit be sufficiently low, that is, make a relevant wavelength sufficiently long. Therefore, it is necessary to make a length for which the antenna extends linearly be sufficiently short. As a result, it is not possible to make a size of a single loop antenna sufficiently large. Therefore, in order to realize a wide detection area, it is necessary to provide many loop antennas.

Figure 23B:
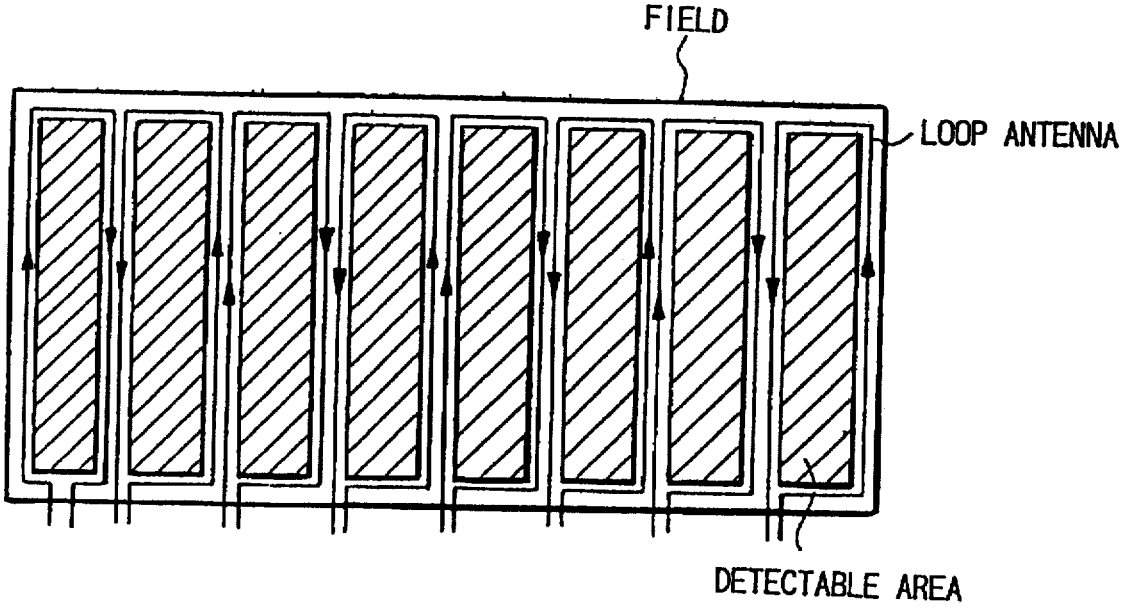

FIGS. 23A, 23B, 24A and 24B show examples of antennas usable in an apparatus for determining a part of an object according to the present invention. As described above, only by a single pair of vertically extending linear antennas forming a loop such as that shown in FIG. 23A, that is, a pair of linear electric wires each extending vertically in FIG. 23A, it is not possible to provide a wide detection area. In other words, it is not possible to provide an area for causing a uniform electric current to be induced in a coil of a tank circuit of the die present on the field. By providing a plurality of loop antennas as shown in FIG. 23B, it is possible to provide such a wide detection area. In a formation shown in FIG. 23B, a plurality of loop antennas, each being a single loop antenna such as that shown in FIG. 23A, are arranged laterally in parallel.

Figure 24A:
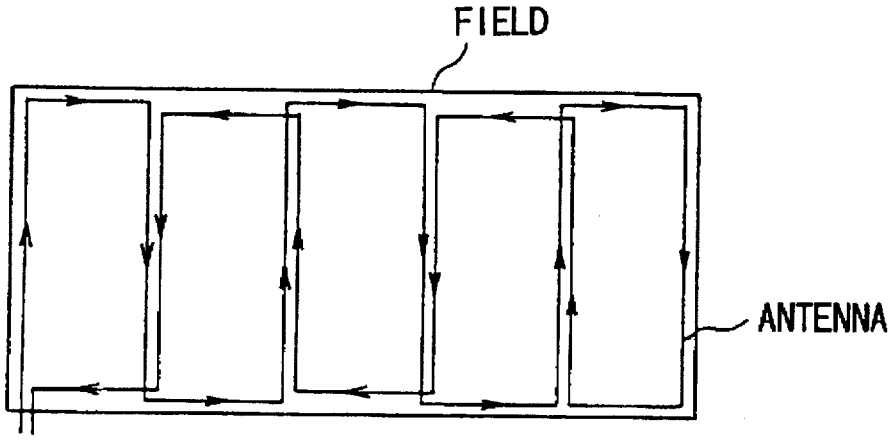
Figure 24B:
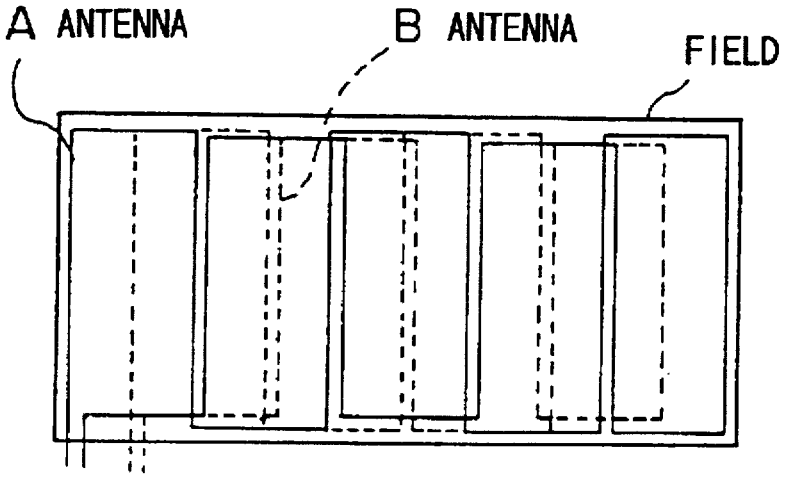

Further, as shown in FIG. 24A, it is possible to provide a vertically linearly extending antenna simply using a single electric wire, which antenna is substantially equivalent to the formation of antennas shown in FIG. 23B. However, in such a formation, dead zones are present on a wire of the antenna, and if a coil is present therein, it is not possible to appropriately induce an electric current in the coil. As a result, no significant electromagnetic wave is transmitted from the tank circuit having the coil, and thus the analyzing unit 230 cannot detect the presence of the tank circuit.

In order to prevent such a situation, two sets of antennas A and B, each being identical to the antenna shown in FIG. 24A, are overlaid on each other as shown in FIG. 24B. In a formation shown in FIG. 24B, the antenna B is shifted horizontally, half an interval between each adjacent pair of wires, from the antenna A. As a result, as described above, it is possible to cancel dead zones of the two systems of antennas A and B by each other.

Figure 25A:
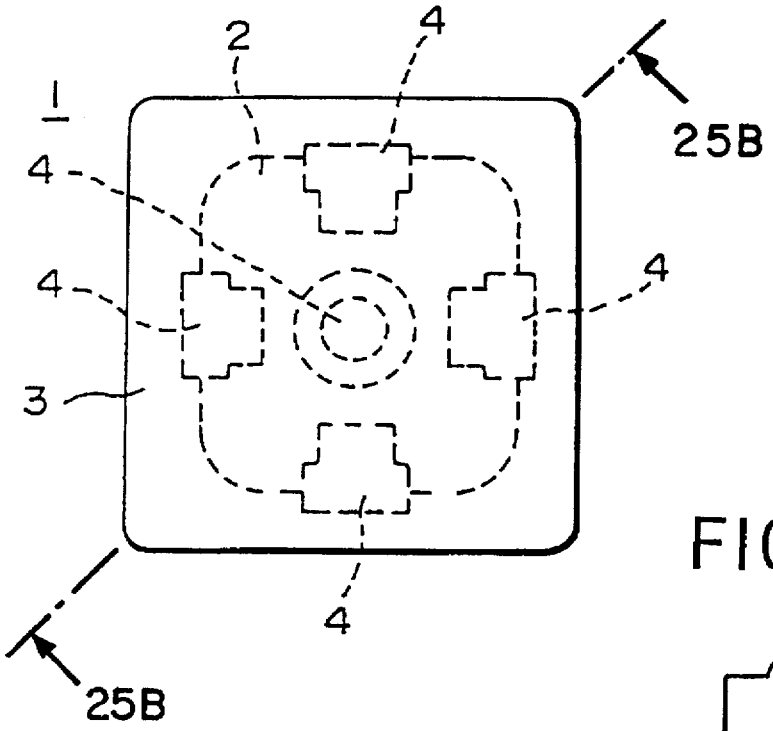
FIGS. 25A, 25B and 25C show a construction of a die used in the dice game machine shown in FIGS. 2A, 2B and 2C.

FIG. 25A shows a front view of the die used in the rolled number determining system of the dice game machine 10 in the embodiment of an apparatus for determining a part of an object according to the present invention, the die acting as this object. FIG. 25B shows a partial sectional view of the die along a line B—B in FIG. 25A. Further, FIG. 25C shows a circuit diagram of a transponder shown in FIG. 25A.

This die 1 is approximately a cube, a square of each side having dimensions of 80 mm by 80 mm, and includes a cube-shaped middle part 2 and a cover 3 covering the middle part 2 with a predetermined thickness. This middle part 2 is formed of a polyurethane foam and the cover 3 is formed of ABS resin. Further, as shown in the figure, the transponder 4 formed of the above-described tank circuit is embedded in each side of six sides of the middle part 2 in a manner in which a part of the transponder 4 projects from the relevant side.

Figure 25C:
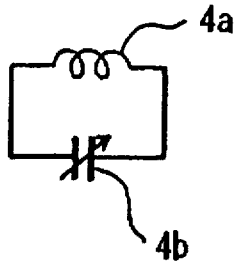
Figure 25B:
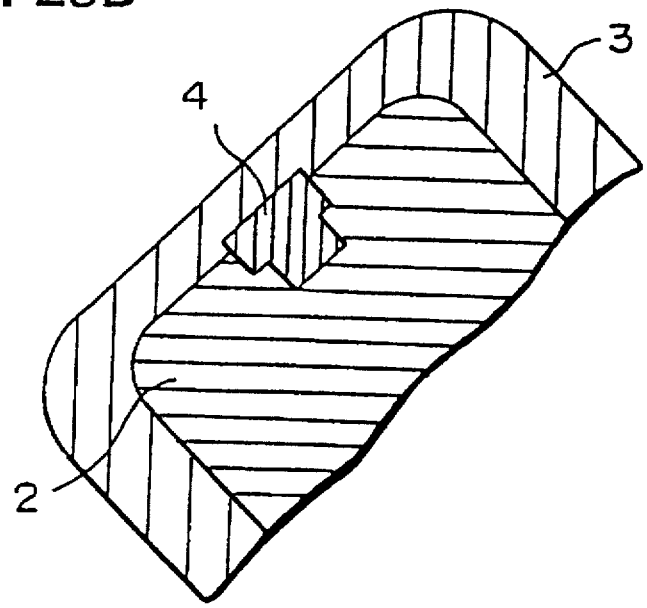

Each transponder 4 is formed of a parallel circuit (tank circuit) of a coil 4*a* and a variable capacitance capacitor (trimmer capacitor) 4*b*, as shown in FIG. 25C. The axis of the coil 4*a* of the tank circuit extends perpendicular to the relevant side of the middle part 2. In other words a plane including each winding turn of the coil is in parallel to the side. Each transponder 4 embedded in a respective side of the middle part 2 is the transponder provided inside the die 1 in proximity to the relevant side of the die 1, that is, in proximity to the relevant side of the cover 3.

Each transponder 4 has a resonant circuit, that is, a tank circuit which acts as a resonant circuit provided in an object of 'an apparatus for determining a part of the object' according to the present invention. The resonant circuit of each transponder has a resonance frequency different from that of another transponder. Further, in the dice game machine 10 shown in FIG. 2, two similar dice 1 are used, each die having six transponders, and thus a total twelve of transponders are used. Among the twelve transponders, the resonance frequencies of the resonant circuits are different from one another. In other words, twelve different resonance frequencies are assigned to the twelve transponders, respectively.

Further, a resonance frequency assigned to each transponder in proximity to a side of a die is assigned to a die number of an opposite side of the die. For example, if a die number of the top side of the die 1 shown in FIG. 25A is '1', a die number of an opposite side, that is, the bottom side is '6'. In this case, a resonance frequency of a resonant circuit of a transponder 4 which is embedded to project from the topside of the middle part 2 is assigned to the die number of '6'. A resonance frequency of a resonant circuit of a transponder 4 which is embedded to project from the bottom side of the middle part 2 is assigned to the die number of '1'. Similarly, for the other sides of the die 1, resonance frequencies are assigned to the relevant transponders.

Thereby, when the die 1 stops on the field 24, among electromagnetic waves sent out from the antenna 24*a* (see FIG. 26B) provided in the field 24, an electromagnetic wave of the highest level sent out from a transponder 4 is received by the antenna 24*a*. This transponder 4 is one which is embedded in the die so as to project from a bottom side of the middle part 2 and thus is in the closest proximity to the antenna 24*a*. Accordingly, among the electromagnetic waves received by the antenna 24*a*, a received level of a frequency component corresponding to a resonance frequency of this transponder 4 is highest.

The resonance frequency of this transponder 4 indicates the die number of the top side of the stopped die 1. Thus, the resonance frequency corresponding to the frequency components received by the antenna 24*a* of the highest level indicates the side number of the top side of the die, that is, a rolled number of the die 1. Therefore, by detecting the frequency component having the highest reception level, the rolled number of the die can be determined.

It is necessary to form each of the dice so as to have a correct weight balance so that each die number has an equal chance of becoming a rolled number. In other words, possibilities of each side of the die 1 facing upward after rolling thereof is stopped should be equal to one another. For this purpose, it is necessary to positioning each transponder of the six transponders so that distances thereof to the center of the cube are equal to one another.

Further, it is preferable that the die 1 is thrown, that is, that the shooting mechanism 114 shown in FIGS. 8–11 shoots the die 1, with further rolls on the field 24 after falling thereon. Thus, it is not easy for each player to determine a rolled number of the die in an earlier stage before the die 1 stops. By concentrating a weight distribution inside the die 1 at the center thereof, it is possible to form the die 1 to be easy to roll. For this purpose, it is preferable that each transponder 4 is positioned near the center of the die 1.

However, it is necessary that a frequency component corresponding to a resonance frequency of a transponder of the bottom side of the stopped die 1 is received by the antenna 24a in the highest level. For this purpose, it is necessary to position each transponder away from the center of the die 1 and thus in proximity to a relevant side of the die.

A position of each transponder in the die should be determined to be the optimum one after considering the above-mentioned directly-opposing requirements.

Figure 26A:
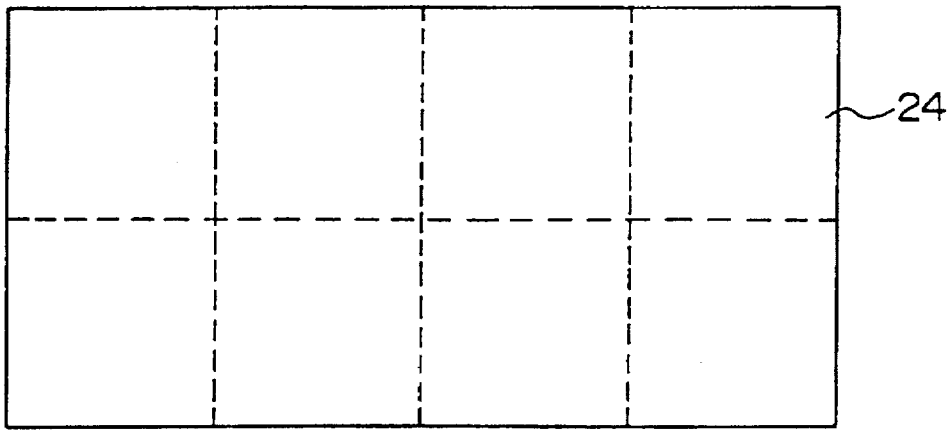
FIGS. 26A and 26B show a construction of a field used in the dice game machine shown in FIGS. 2A, 2B and 2C.
Figure 26B:
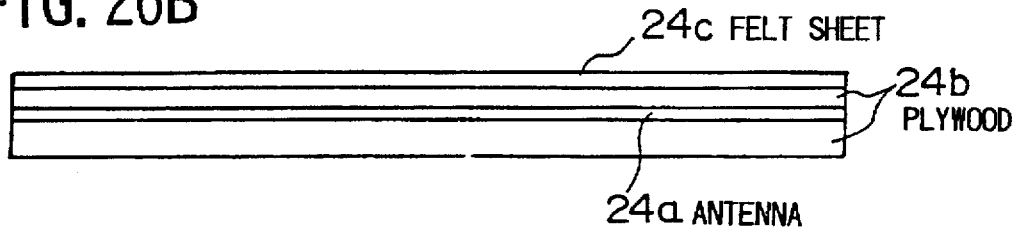

FIG. 26A shows a plan view of the field 24 shown in FIG. 2A, and FIG. 26B shows a side elevational view of the field shown in FIG. 26A. The field 24 has, as shown in FIG. 26A, a rectangular shape of a size of 2 m by 1 m, and, as shown in FIG. 26B, has the above-mentioned antenna 24a therein. The field 24 is, as shown in FIG. 26A, equally divided into 8 divisions. Each division thereof is used as an independent detection area, and provided with two systems of antennas A and B as show in FIG. 24B. The antenna 24a formed of 8 systems, each system being further formed of two systems of antennas A and B, is formed by copper wires, and thus has a formation such that rolled numbers of two dice 1 can be determined, the two dice having stopped at any position on the field 24.

Although not shown in the figures, the detecting unit 220 shown in FIG. 17 has a circuit for sequentially changing the two systems of antennas A and B to be used over the eight detection areas by the control by the control unit 221. Thereby, the eight detection areas are scanned sequentially, and thus the dice 1 present in any detection area thereamong can be detected. Instead of thus scanning the eight detection areas, it is also possible to provide eight detecting units, each unit being the same as the detecting unit 220 shown in FIG. 17. As a result, it is possible to perform die rolled number determining on the eight detection areas at the same time.

As shown in FIG. 26B, the antenna 24a are sandwiched by the plywood 24b at the top and bottom sides thereof, and a felt sheet 24c is stuck on the top plywood 24b. By sandwiching the antenna 24a with the plywood 24b, the antenna 24a is reinforced and thus a lifetime thereof can be elongated. Further, an appropriate picture may be provided on the felt sheet 24c so as to enhance the decor. A sensitivity of the antenna 24a is adjusted appropriately depending on thicknesses of the top plywood 24b and felt sheet 24c and thus transmission of electromagnetic waves toward the dice 1 which have stopped on the field 24 and reception of electromagnetic waves transmitted from the dice 1 are surely performed.

Figure 27:
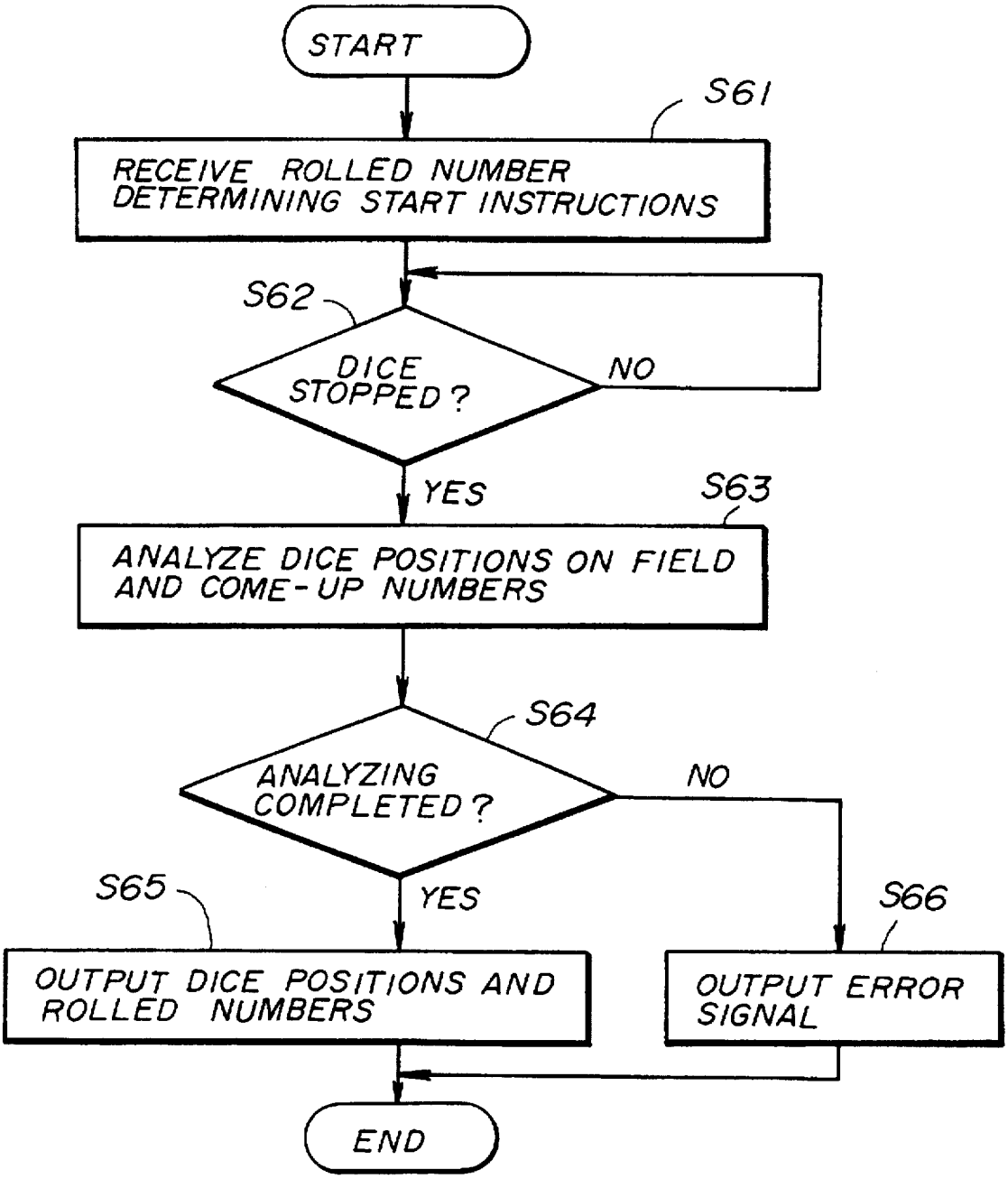
FIG. 27 shows a flowchart of a rolled number determining operation performed by the control unit shown in FIG. 17.

FIG. 27 shows a flowchart of a rolled number determining operation performed by the control unit 221 of the detecting unit 220. In S61, the field control unit 200 supplies rolled number determining operation starting instructions. Then, in S62, it is determined whether or not movement of the dice has stopped. Specifically, information of an electromagnetic wave receiving level for each frequency component is monitored through the analyzing unit 223 for a predetermined time period. As a result, if it is determined that the receiving level does not substantially vary, it is determined that the dice have stopped on the field 24. In fact, while the dice are rolling on the field 24, a distance between each transponder of the dice and the antenna 24a is varying, and thus the electromagnetic wave receiving level is varying.

In S63, positions of the dice on the field 24 and rolled numbers thereof are analyzed. As described above, in the rolled number determining system used in the dice game machine 10, the field 24 shown in FIG. 26A is divided into the eight detection areas, and thus the antenna 24a is divided into eight divisions accordingly. Therefore, first, it is determined in which detection areas the stopped dice are present. Specifically, two areas having the highest receiving levels of electromagnetic waves sent out from the dice are determined to be the areas at which the stopped dice are present.

There may be a case where the two dice are present in a single detection area. In this case, the electromagnetic wave receiving level should be extremely high in the relevant area in comparison to those of the other areas. Therefore, by determining that a single area has an extremely high electromagnetic wave receiving level, it can be determined that the two dice are present in a single detection area.

After the areas in which the dice are present have been determined, rolled numbers thereof are determined. By separating the rolled number determining operation into two stages of die position determination and die rolled number determination, it can be possible to consequently determining rolled numbers surely, at high speed. Further, by storing the thus-determined die positions in a memory, when the dice game machine 10 is maintained afterward, it is possible to examine operations of the dice game machine 10 by analyzing motion of the dice on the field 24 for a preceding period. By performing such a examination, for example, the function of the shooting mechanism 114, constructional characteristics of the dice 1, and so forth can be verified.

In S64, it is determined whether or not the analyzing operation of S63 has been normally completed. For example, if the two dice 1 are stuck on top of each other as shown in FIG. 28B, it is determined that an abnormal state occurs in the analyzing operation, and then in S66, as mentioned above, an error signal is sent out to the field control unit 200.

Figure 28A:
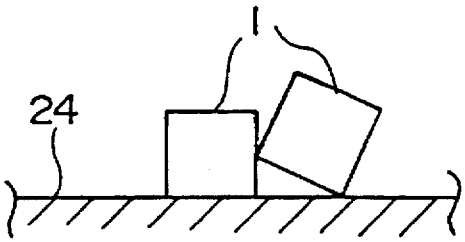
FIGS. 28A and 28B show examples of possible stopped states of two dice in the dice game machine shown in FIGS. 2A, 2B and 2C.
Figure 28B:
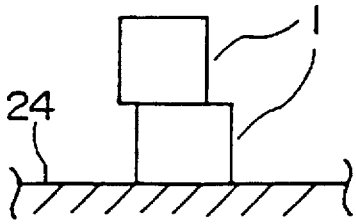

FIGS. 28A and 28B show possible states of the dice 1 which have stopped on the field 24. In the state shown in FIG. 28A, the entire surface of a side of the left die is in contact with the field 24, while the right die has no side, the entire surface of which is in contact with the field 24 due to the inclination of the die. In fact, the bottom left edge of the right die touches the right side of the left die and thus the right die is inclined.

In the present embodiment, even if there is a die in an inclined state such as that shown in FIG. 28A, as long as the inclination angle is less than 30°, the control unit 221 treats this state as a normal state and determine a die number of the top side of the die as a rolled number of the die which is then supplied to the field control unit 200. In fact, if an inclination angle is less than 30°, the detecting unit 220 can obtain a significant difference between receiving levels of electromagnetic waves sent out from a transponder embedded so as to project from the oblique bottom side of the middle part of a die and another transponder of the die. As a result, it is possible to determine a rolled number of the die.

Further, in an inclination of such an amount of a die, each player may not object to the determination of a die number of an oblique top side of the die as being a rolled number. If a program were used according to which an inclination in such an amount of a die results in an invalid determination and thus re-shooting of the dice is needed, each player would have to wait for a re-shooting operation and thus may be dissatisfied.

If it is determined in S64 that the analyzing operation has been normally completed, a result of the analysis is supplied to the field control unit 200 in S65. The rolled number information between the thus-supplied die position information and the rolled number information is used to determine a relevant game result and then points are allotted to each player.

Thus, objects used in the dice game machine for determining a game result are the dice 1, each being formed of a cube (regular hexahedron). However, an object used in 'an apparatus for determining a part of an object' according to the present invention is not limited to such a die of a regular hexahedron. Another regular polyhedron having a larger number of sides and a sphere may used as the object. Further a coin having different numbers on the two sides may be used as the object.

Figure 29A:
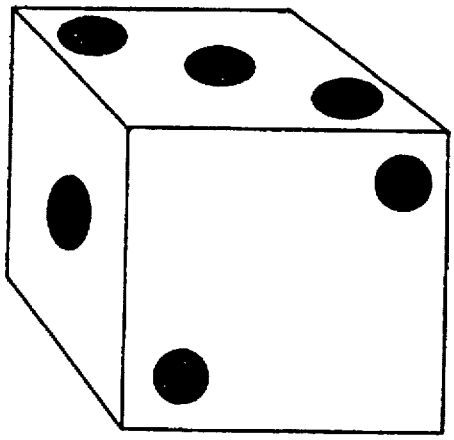
FIG. 29A, 29B, 29C and 29D show perspective views of objects which may be used to realize the present invention.
Figure 29B:
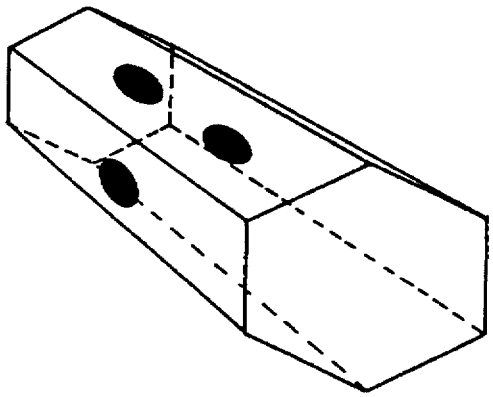

FIGS. 29A, 29B, 29C and 29D show perspective views of formation examples of objects which may be used in an apparatus for determining a part of an object according to the present invention. FIG. 29A shows a general die of a regular hexahedron and, on six sides thereof, numerals 1, 2, 3, 4, 5 and 6 are indicated by numbers of pips as shown in the figure. FIG. 29B shows a hexagonal-cross-section pencil-like object and, on six sides thereof, numerals 1, 2, 3, 4, 5 and 6 are indicated by numbers of pips as shown in the figure similar to the general dice. Even if such a pencil-like object pencil-like object is used instead of the general die, determining of a direction thereof, that is, rolled number determining can be performed using a principle similar to that according to which the above-described rolled number determining of the regular hexahedron object (dice) is performed. Specifically, a transponder is positioned in a proximity of each side of the six sides of the hexagon of the pencil-like object. Each transponder is positioned in a side opposite to a relevant side. That is, a transponder relevant to the top side when this object stops is provided in proximity to the bottom side and, an electromagnetic wave of the highest level is sent out from this transponder and received by an antenna.

Figure 29C:
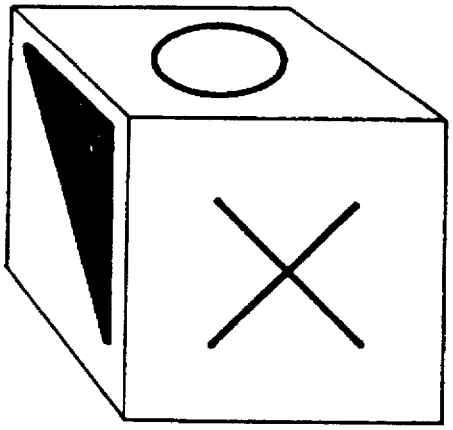
Figure 29D:
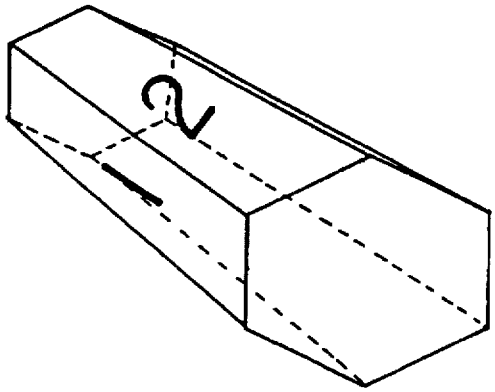

FIGS. 29C and 29D show objects having a regular hexahedron and a pencil shape similar to those shown in FIGS. 29A and 29B. In a formation shown in FIG. 29C, a picture drawn in each side of a die is not a numeral represented by a number of pips, but a shape such as a circle, a triangle, and 'X'. Further, in a formation shown in FIG. 29D, a numeral drawn in each side of a die is not represented by a number of pips, but by a numeral figure itself.

As described above, according to the present invention, sides of an object are determined by detecting resonance frequencies of resonant circuits embedded in the object. Therefore, according to the present invention, the determination does not depend on a picture which is drawn in each side of the object and a side of the object is precisely determined. Thus, it is possible to determine the picture drawn in each side of the object consequently.

Even any object having a shape other than a regular hexahedron, as long as the object may stop in a plurality of positions and a transponder relevant to a substantially top part of the object is provided in a substantially bottom part of the object, can be used in an apparatus for determining a part of an object according to the present invention.

Further, the present invention is not limited to the above-described embodiments, and variations and modifications may be made without departing from the scope of the present invention.

What is claimed is:

1. An apparatus for determining a part of an object, comprising:

an object having a plurality of parts, wherein each part of said plurality of parts can face a predetermined direction;

a plurality of resonant circuits, mounted in different predetermined positions of said object, and having different resonance frequencies;

sending means for sending signals having a plurality of frequencies corresponding to said resonance frequencies of said plurality of resonant circuits; and detecting means for detecting resonance signals of said plurality of resonant circuits.

2. The apparatus according to claim 1, further comprising;

a plate having therein said sending means and detecting means; and determining means for determining a part of said object placed on said plate, said part facing said predetermined direction, using differences of detected levels of said resonance signals of said plurality of resonant circuits of said object detected by said detecting means.

3. The apparatus according to claim 1, further comprising control means for controlling said sending means and detecting means;

wherein:

said control means controls said sending means so that said sending means sends, one at a time, signals having frequencies equal to said plurality of resonance frequencies of said plurality of resonant circuits, in a manner in which the signal of a resonance frequency is sent, sending is stopped for a predetermined time, and then the signal of a subsequent resonance frequency is sent; and said control means controls said detecting means so that, during a time in which said sending means stops sending the signal, said detecting means detects a reverberation oscillation of said plurality of resonant circuits which is caused by the signal sent immediately before, and compares a phase of the detected reverberation oscillation with a phase of said signal sent immediately before.

4. The apparatus according to claim 1, wherein said sending means includes an antenna comprising an electric wire forming at least one loop, and a formation of said antenna and said plurality of resonant circuits is such that each of said resonance frequencies of said resonant circuits is sufficiently low in comparison to a resonance frequency of said antenna and, as a result, a wavelength corresponding to said resonance frequency of said antenna is so short that said wavelength may be neglected in comparison to wavelengths corresponding to said resonance frequencies of said resonant circuits.

5. An object, a part of which can be automatically determined, comprising:

a plurality of parts, wherein each part of said plurality of parts can face a predetermined direction; and a plurality of resonant circuits, mounted in different predetermined positions of said object, and having different resonance frequencies.

6. The object according to claim 5, wherein said object comprises a polyhedron and a respective one of said plurality of parts corresponds to each side of said polyhedron.

7. The object according to claim 6, wherein a respective one of said resonant circuits is provided in each of said sides of said polyhedron.

8. The object according to claim 5, wherein said plurality of parts can be visually identified by different numbers provided on said plurality of parts.

9. The object according to claim 5, wherein said object comprises a plurality of objects.

10. The object according to claim 5, wherein each of said resonant circuits comprises a tank circuit comprising a coil and a capacitor, said plurality of resonance frequencies being different as a result of capacitances of the capacitors being different.

11. A game apparatus for playing a game of chance wherein a die, for providing a score, is thrown onto a controlled playing field, comprising:

an enclosed playing field for supporting the die;

a plurality of player satellite stations positioned around the playing field to enable a subjective input of playing instructions by each player;

means for automatically collecting the die from the playing field;

means for projecting the die onto the playing field; and means for determining a score of the projected die, including a plurality of passive resonant circuits, one for each face of the die, positioned in the die, and means for addressing each resonant circuit and detecting resonance signals induced in the resonant circuits to determine the position of a face of the die resting on the playing field after it is projected by the means for projecting.

12. The game apparatus of claim 11, wherein the means for addressing each resonant circuit includes an antenna in the playing field and a filter circuit connected to the antenna to distinguish a magnitude of the resonance signals.

13. The game apparatus of claim 12, wherein a pair of antennas are provided.

14. The game apparatus of claim 13, wherein the pair of antennas are mounted in a parallel arrangement in the playing field.

15. The game apparatus of claim 13, wherein the playing field is enclosed with a transparent dome.

16. The game apparatus of claim 13, wherein the antennas are mounted in the configuration of loops.

* * * * *

UNITED STATES PATENT AND TRADEMARK OFFICE

CERTIFICATE OF CORRECTION

PATENT NO. : 5,694,045

DATED : December 2, 1997

INVENTOR(S) : Yuji Ikeda et al.

It is certified that error appears in the above-identified patent and that said Letters Patent is hereby corrected as shown below:

On the cover page, [73] Assignee, delete "Sega Enterproses, Ltd."

and insert --Sega Enterprises., Ltd.--

Signed and Sealed this

Fourteenth Day of April, 1998

Bruce Lehman

*Attest:*

BRUCE LEHMAN

*Attesting Officer*

*Commissioner of Patents and Trademarks*